US010450837B2

(12) United States Patent
Gan et al.

(10) Patent No.: US 10,450,837 B2
(45) Date of Patent: Oct. 22, 2019

(54) SLEEVE FRACTURING ASSEMBLY, DEVICE USING THE SAME AND METHOD FOR USING THE SAME

(71) Applicants: CHINA PETROLEUM & CHEMICAL CORPORATION, Beijing (CN); CHINA PETROLEUM AND CHEMICAL CORPORATION SOUTHWEST OIL AND GAS COMPANY, Chengdu (CN)

(72) Inventors: Zhenwei Gan, Chengdu (CN); Qiusheng Huang, Chengdu (CN); Shan Ren, Chengdu (CN); Guangquan Li, Beijing (CN); Jihao Wu, Beijing (CN)

(73) Assignees: CHINA PETROLEUM & CHEMICAL CORPORATION, Beijing (CN); CHINA PETROLEUM & CHEMICAL CORPORATION SOUTHWEST OIL & GAS COMPANY, Chengdu (CN)

( * ) Notice: Subject to any disclaimer, the term of this patent is extended or adjusted under 35 U.S.C. 154(b) by 157 days.

(21) Appl. No.: 15/583,143

(22) Filed: May 1, 2017

(65) Prior Publication Data

US 2017/0234110 A1 Aug. 17, 2017

Related U.S. Application Data

(62) Division of application No. 14/127,704, filed as application No. PCT/CN2012/077287 on Jun. 21, 2012, now Pat. No. 9,708,889.

(30) Foreign Application Priority Data

Jun. 22, 2011 (CN) ..... 2011 1 0170557
Jun. 22, 2011 (CN) ..... 2011 1 0170564

(51) Int. Cl.
*E21B 34/14* (2006.01)
*E21B 34/12* (2006.01)
(Continued)

(52) U.S. Cl.
CPC ..... *E21B 34/14* (2013.01); *E21B 34/12* (2013.01); *E21B 43/26* (2013.01); *E21B 2034/007* (2013.01)

(58) Field of Classification Search
CPC ..... E21B 34/14; E21B 34/06; E21B 2034/007
See application file for complete search history.

(56) References Cited

U.S. PATENT DOCUMENTS 8,944,169 B2 2/2015 Campbell

FOREIGN PATENT DOCUMENTS

CN 2100480 U 4/1992
CN 201144682 Y 11/2008
(Continued)

OTHER PUBLICATIONS

International Search Report (PCT/ISA/210) dated Oct. 4, 2012, by the State Intellectual Property Office of China as the International Searching Authority for International Application No. PCT/CN2012/077287.

(Continued)

*Primary Examiner* — Robert E Fuller
(74) *Attorney, Agent, or Firm* — Buchanan Ingersoll & Rooney PC

(57) ABSTRACT

A sleeve fracturing assembly includes a composite sleeve and an opening tool. The composite sleeve and the opening tool can automatically engage with each other via teeth-shaped members arranged thereon so as to open the composite sleeve. A sleeve fracturing device includes a plurality of composite sleeves and opening tools, wherein each composite sleeve and opening tool can achieve unique engage- (Continued)

ment. A method of using the sleeve fracturing device is also described.

20 Claims, 15 Drawing Sheets

(51) Int. Cl.
*E21B 43/26* (2006.01)
*E21B 34/00* (2006.01)

(56) References Cited

FOREIGN PATENT DOCUMENTS

| | | | |
|---|---|---|---|
| CN | 201144683 | Y | 11/2008 |
| CN | 201165861 | Y | 12/2008 |
| CN | 201165862 | Y | 12/2008 |
| CN | 101338663 | A | 1/2009 |
| CN | 201190552 | Y | 2/2009 |
| CN | 101418681 | A | 4/2009 |
| CN | 101560877 | A | 10/2009 |
| CN | 201396131 | Y | 2/2010 |
| CN | 202125287 | U | 1/2012 |
| CN | 202125288 | U | 1/2012 |
| CN | 202125289 | U | 1/2012 |
| CN | 202125290 | U | 1/2012 |
| CN | 202266250 | U | 6/2012 |
| CN | 202266251 | U | 6/2012 |

OTHER PUBLICATIONS

Office Action dated Jun. 30, 2015, by the Patent Office in corresponding Kazakhstan National Phase Application No. 2014/1511.1. (2 pages).

SLEEVE FRACTURING ASSEMBLY, DEVICE USING THE SAME AND METHOD FOR USING THE SAME

CROSS REFERENCE TO RELATED APPLICATIONS

This application is a division of U.S. application Ser. No. 14/127,704, filed on Dec. 19, 2013, which is a national stage of PCT/CN2012/077287, filed on Jun. 21, 2012, which in turn claims priority to Chinese Application Nos. 201110170564.6 and 201110170557.6, both of which filed on Jun. 22, 2011. The content of each prior application is hereby incorporated by reference in its entirety.

TECHNICAL FIELD

The present disclosure relates to a sleeve fracturing assembly, in particular to a sleeve fracturing assembly that can be selectively opened or closed. The present disclosure further relates to a device comprising the assembly as well as a method of using the device.

TECHNICAL BACKGROUND

A layer transfer sandblasting sleeve is a key tool in staged fracturing of vertical wells and horizontal wells in oil and gas fields. A sandblasting sleeve of this kind comprises an outer tube and a core tube disposed in the outer tube, wherein the outer tube and the core tube form a sliding fit. A wall of the outer tube of the sleeve is provided with a sandblasting hole, an upper end port of which has a sealed fitting surface for receiving a starting ball, which starts the sliding of the outer tube and the core tube of the sleeve. The size of the starting ball and that of the sealed fitting surface increase in accordance with a certain gradient sequence. Each starting ball has a diameter larger than the inner diameter of the fitting surface engaged with said starting ball, so that each starting ball can merely engage with a unique corresponding sealed fitting surface. During operation, corresponding starting balls are successively thrown down and a corresponding shear pin is sheared under the pressure built in the wellbore, so that the sleeve can be opened.

Currently, there are two steering fracturing methods for horizontal and vertical oil and natural gas wells, i.e., limited entry fracturing and staged fracturing. Staged fracturing is the dominating method, including chemical staged fracturing, packer staged fracturing, hydraulic staged fracturing, coiled tubing staged fracturing and combined completion, among which the most widely used is packer staged fracturing, including pumping bridge plug staged fracturing, ball and sleeve packer segment, annular packer and double sealed single pressure staged fracturing, etc.

Among the above methods, annular packer and the pumping bridge plug staged fracturing methods have no limitation on the number of stages. The fracturing operations thereof, however, cannot be continuously performed. Re-perforation is required after the operation is completed in each stage. After the operations are completed, well killing and plug drilling are needed, which result in long periods of operations and high costs. In double sealed single pressure staged fracturing, the casing string needs to be dragged, and the packer requires multiple sealing, whereby the construction period is prolonged. Ball and sleeve packer staged fracturing use a combination of balls and ball seats of different size ranges, so that multi-stage fracturing can be accomplished without operating the casing string. However, because different balls are designed in accordance with a certain size range, the number of packer stages is limited by the size of the casing string, and staged fracturing and acidification series will also be restricted.

In recent years, different sandblasting sleeves for different reservoir characteristics have been successively developed. For example, CN 210048U entitled "Pressure guide sandblasting sleeve for fracturing", which was issued on Apr. 1, 1992, discloses a device mainly used in oil well fracturing. And a device mainly used in gas well fracturing is disclosed in CN 200820061922 entitled "Sandblaster of fracturing sleeve", which was on Nov. 5, 2008. Both of the sleeves as disclosed above are based on the principle of opening sleeves with starting balls, the size of which increases in sequence, whereby the number of staged fracturing is still limited.

In addition, in order to overcome the defects of fracturing devices, a variety of sleeve fracturing devices also have been developed. For example, in CN201396131 entitled "Horizontal well mechanical staged fracturing blocking-proof process pipe column" which was published on Feb. 3, 2010, it discloses a device comprising a tubing string, a pressure differential packer, a safety connector and a slide sleeve packer. The pressure differential packer and the slide sleeve packer are mounted on the tubing string with the safety connector arranged therebetween. This device can only be applied in oil fields, and the packers thereof can be easily damaged during operations, rendering loose sealing and inadequate fracturing. Further, this device is of complex and labor-intensive operations with poor security.

In CN101338663 entitled "Staged fracturing horizontal wells mechanical anti-card technology column", which was published on Jan. 7, 2009, it discloses a device comprising an oil pipe, a safe joint, a centralizer, a hydraulic anchor, a packer, a pressure guide sandblaster and a guide plug, wherein, the lower end of the oil pipe is successively connected with the safe joint, the centralizer, the hydraulic anchor, the packer, the centralizer, the pressure guide sandblaster, the packer and the guide plug. This device can only be used for horizontal well oilfield fracturing, but cannot achieve multi layer fracturing and mining without operating the string, nor can it achieve staged fracturing without operating the string or limiting the number of stages.

In CN101560877 entitled "Horizontal well packer staged fracturing technology tube pillar" which was published on Oct. 21, 2009, it discloses a device comprising an oil string, a hydraulic anchor, a seat sealing controller, a straddle packer A, a straddle packer B, a straddle packer C, a sleeve sandblaster, a sandblaster, a guider and a capillary tube. The oil string is successively provided with the hydraulic anchor, the seat sealing controller, the straddle packer A, the sleeve sandblaster, the straddle packer B, the sandblaster, the straddle packer C and the guider. The capillary tube connects to the seat sealing controller, the straddle packer A, the straddle packer B and the straddle packer C on one side of the oil string. This device, however, cannot achieve unlimited number of staged fracturing.

Moreover, CN101418681 entitled "Once tubular column process for combination oil production by multiple fracturing for oil and gas wells", and CN201144682 entitled "Multiple fracturing pipe column for petroleum and gas wells" both adopt a method of opening the sleeves by throwing balls, wherein unlimited numbers of staged fracturing without operating the column string is impossible, nor can the sleeve be closed.

Therefore, a fracturing device that can open or close any sleeve as required is urgently needed for achieving staged fracturing with unlimited numbers of stages in horizontal, vertical and directional wells without having to operate the tabular column.

SUMMARY OF THE INVENTION

To solve the above problems, the present disclosure discloses a sleeve fracturing assembly, which can open and close a sleeve at any fixed position as required. The present disclosure further discloses a device comprising the assembly and a method of using the device.

According to a first aspect of the present disclosure, it discloses a sleeve fracturing assembly comprising, a composite sleeve having a fixed outer tube and an inner tube connected to an inner wall of the outer tube via a shear pin, wherein the outer tube is provided with a sandblasting hole and an inner wall of the inner tube is provided with a first teeth-shaped member; and an opening tool having a main body and a second teeth-shaped member connected to the main body, wherein the opening tool can be inserted into the inner tube to seal a wellbore, and the second teeth-shaped member can be engaged with the first teeth-shaped member, wherein in an initial state of the sleeve fracturing assembly, the sandblasting hole is blocked by the inner tube; as the opening tool is put down, the inner tube engages with the opening tool via the first and second teeth-shaped members; and when the pressure inside the casing reaches a predetermined value, the shear pin is sheared and the opening tool drives the inner tube to move downward to expose the sandblasting hole, so that a fracturing passage is established.

In the context, the term "initial state" refers to the state before the sleeve fracturing assembly is opened.

In one embodiment, a first closing tool comprising a central pull rod and a fifth teeth-shaped member connected to the central pull rod is further provided for closing the composite sleeve, wherein the first closing tool can be inserted into the inner tube so that the fifth teeth-shaped member can engage with the first teeth-shaped member, whereby the inner tube can be moved upward via lifting the first closing tool, thus re-blocking the sandblasting hole so as to close the fracturing passage.

In one embodiment, a position-selecting groove and a position-selecting member are provided in respective fitting surfaces of the inner tube and the outer tube of the composite sleeve, and are disposed at different positions when the sleeve fracturing assembly is in an open state and when the fracturing passage is closed. That the position-selecting groove and position-selecting member are disposed at different positions in different states of the fracturing assembly can avoid a fluid action, and prevent the composite sleeve from being unexpectedly closed after the closing tool is taken out.

In one embodiment, the fitting surfaces of the outer tube and the inner tube of the composite sleeve are provided with corresponding positioning mechanisms that can be engaged with one another, so as to ensure that the inner tube engages with the outer tube so that the sandblasting hole is blocked and hence the fracturing passage is closed. The positioning mechanisms can ensure that the outer tube of the composite sleeve is separated from the inner tube thereof only when the opening tool is thrown in and pressure is applied, and that the outer tube of the composite sleeve can re-engage with the inner tube thereof to close the fracturing passage when the inner tube is lifted by the first closing tool.

According to the first aspect of the present disclosure, it further provides a sleeve fracturing device, comprising a plurality of the sleeve fracturing assemblies according to the first aspect of the present disclosure. The second teeth-shaped member of each opening tool is configured as different from the second teeth-shaped member of any other opening tool, so that each opening tool can only engage with the inner tube in the fracturing assembly associated with said opening tool. The fifth teeth-shaped member of each first closing tool is configured as different from the fifth teeth-shaped member of any other first closing tool, so that each first closing tool can only engage with the first teeth-shaped member in the inner tube of the fracturing assembly associated with said first closing tool.

This configuration allows the second teeth-shaped member of the opening tool associated with a specific fracturing assembly can only engage with the first teeth-shaped member of the composite sleeve in said fracturing assembly. Even when the opening tool is put down passing through other fracturing assemblies, the second teeth-shaped member of the opening tool cannot radially move outward to engage with the first teeth-shaped member of the composite sleeve thereof due to differences in the teeth-shaped members. Similarly, the fifth teeth-shaped member of the first closing tool can also only engage with the first teeth-shaped member of the composite sleeve associated with said first closing tool. Therefore, in the device according to the first aspect of the present disclosure, when a specific opening tool is put down, only the corresponding composite sleeve can be opened, and when a specific first closing tool is put down, only the corresponding composite sleeve can be closed. That is, the sleeve fracturing device according to the present disclosure can selectively open and/or close the specific composite sleeve as required.

In one embodiment, all the composite sleeves have the same inner diameter, which allows unlimited numbers of composite sleeves for unlimited numbers of staged fracturing.

In one embodiment, each of the teeth-shaped members can engage with the unique corresponding teeth-shaped member via unique contour parameters thereof and/or a guiding structure arranged thereon. In a preferred embodiment, the contour parameters are one or more selected from a group consisting of tooth number, tooth profile and teeth space.

In one embodiment, the second teeth-shaped member of the opening tool is provided on the outer wall of the main body with a third spring mechanism disposed between the main body and the second teeth-shaped member, wherein the second teeth-shaped member can move radially outward under the actuation of the third spring mechanism so as to engage with the first teeth-shaped member. In another embodiment, the second teeth-shaped member of the opening tool is provided above the main body via an elastic member, one end of the elastic member connected to the main body having a smaller diameter than the other end of the elastic member connected to the second teeth-shaped member.

In one embodiment, the fifth teeth-shaped member of the first closing tool is provided on an outer wall of the respective central pull rod with a fourth spring mechanism disposed between the central pull rod of the first closing tool and the fifth teeth-shaped member, wherein the fifth teeth-shaped member can move circumferentially outward under the actuation of the fourth spring mechanism so as to engage with the corresponding teeth-shaped member. In another embodiment, the fifth teeth-shaped member of the first closing tool is a leaf spring member, a downstream end of which is connected to the central pull rod and an upstream end thereof is separated from the central pull rod.

In one embodiment, each of the spring mechanisms according to the first aspect of the present disclosure comprises an elastic member that can exert a radially outward force, and a limit stop for limiting the distance of the corresponding teeth-shaped members that can move circumferentially outward.

The teeth-shaped member having elasticity and the elastic member with a spring mechanism enable said teeth-shaped member to automatically eject out when bumping against an engageable teeth-shaped member and to engage with the same, whereby the automatic engagement between the inner tube of the composite sleeve and the opening tool as well as that between the inner tube and the first closing tool can be achieved in the well, thus greatly improving convenience in operations of the composite sleeve. The limit stop for limiting the distance that the teeth-shaped member outwardly moves can not only ensure engagement between corresponding teeth-shaped members, but also prevent the teeth-shaped member from disengaging from the component to which the teeth-shaped member is connected, such as the main body of the opening tool and the central pull rod of the first closing tool.

In the context, the terms "below" and "above" or the like are respectively specified as being close to and far from the wellhead. And the terms "downstream" and "upstream" are used with respect to the flow direction of the fracturing fluid injected from the wellhead.

In one embodiment, each of the teeth-shaped members is provided with an inclined guiding structure at an upper end and a lower end thereof for guiding engagement or disengagement of the corresponding teeth-shaped member. This inclined guiding structure allows the engagement or disengagement of the corresponding teeth-shaped member to be achieved by being "pressed in" or "pressed out", facilitating the opening or closing operation of the composite sleeve.

In one embodiment, the main body of the opening tool comprises a through hollow structure with different sizes of cross sections, wherein a lower portion of the through hollow structure with a larger cross section is arranged with a pressureout mechanism, which cannot be disengaged from the lower portion of the through hollow structure, in particular cannot enter into the upper portion of the through hollow structure with a smaller cross section.

In a preferred embodiment, the pressureout mechanism comprises a cage and a sphere arranged inside the cage, wherein the cage comprises an open lower end, a sealed upper end with a fishing handle at an outer side thereof, and a fluid passage on a circumferential wall of the cage, the sphere merely being capable of moving inside the cage without blocking the fluid passage on the circumferential wall of the cage when being disposed at the upper or lower end thereof.

The blocking function of the ball to the through hollow structure enables the opening tool of the through hollow structure to apply pressure in the wellbore. Because the cage can merely move in the lower portion of the through hollow structure with a larger cross section, the opening tool can be fished from the composite sleeve by the fishing handle arranged outside of the sealed upper end of the cage.

In a preferred embodiment, the fluid passage on the circumferential wall of the cage has a total area not less than the opening area at the lower end of the cage, which facilitates flow of the fluid.

In one embodiment, the sleeve fracturing assembly further comprises a cylindrical fishing tool that can be inserted into the opening tool and run through the hollow structure. One end of the cylindrical fishing tool is provided with a fishing head to be connected with the fishing handle arranged on the cage, so that the opening tool can be fished by lifting the cage, so that the fishing work is facilitated.

In one embodiment, a lower portion of the main body of the opening tool is further provided with a guide mechanism which extends downward, wherein the guide mechanism comprises a hollow structure communicating with the main body. After the opening tool engages with the inner tube of the composite sleeve, the guide mechanism can enable the opening tool and the inner tube of the composite sleeve to move more stably under pressure.

The first aspect of the present disclosure further relates to a method of using the sleeve fracturing device according to the first aspect of the present disclosure, comprising:

Step I: mounting a pressure gradient opening mechanism at the lowest end of a casing or tubing string, and then successively mounting the composite sleeves in each fracturing assembly;

Step II: applying pressure in the wellbore to open the pressure gradient opening mechanism at the lowest end and establishing a communication passage between the casing or tubing string with stratum; and Step III: putting down the opening tools in sequence to open the composite sleeves from bottom to top for carrying out staged fracturing.

In one embodiment, Step IV is further provided: recovering the opening tool through a fishing structure on the opening tool to restore the passage in the casing or tubing string. In another embodiment, when a specific fracturing passage needs to be closed, the first closing tool of the corresponding composite sleeve associated with said fracturing passage is put down so as to close the fracturing passage.

Since the opening tool, the first closing tool and the composite sleeve can merely achieve unique engagement, each time an opening tool is thrown down, only the corresponding composite sleeve can be opened to establish a corresponding fracturing passage. At the same time, each first closing tool can only close one corresponding fracturing passage. Therefore, any composite sleeve in a horizontal or vertical well can be opened or closed, and thus staged fracturing is achieved.

According to a second aspect of the present disclosure, it provides a sleeve fracturing assembly comprising, a composite sleeve having a fixed outer tube and an inner tube connected to an inner wall of the outer tube via a shear pin, wherein the outer tube is provided with a sandblasting hole and an inner wall of the inner tube is provided with a first teeth-shaped member;

an opening tool having a hollow tabular main body, a second teeth-shaped member arranged on the main body, a third teeth-shaped member arranged on an inner wall of the main body, and a first spring mechanism disposed between the main body and the second teeth-shaped member, wherein the opening tool can be inserted into the inner tube, and the second teeth-shaped member can move radially outward under the actuation of the first spring mechanism so as to be coupled with the first teeth-shaped member; and a driving tool with a central body, a fourth teeth-shaped member arranged on an outer wall of the central body, and a second spring mechanism disposed between the central body and the fourth teeth-shaped member, wherein the driving tool can be inserted into the opening tool so as to seal the wellbore, and the fourth teeth-shaped member can move radially outward under the actuation of the second spring mechanism so as to be coupled with the third teeth-shaped member, wherein in an initial state of the sleeve fracturing assembly, the sandblasting hole is blocked by the inner tube; as the opening tool and the driving tool are successively put down, the inner tube engages with the opening tool via the first and second teeth-shaped members, and the opening tool engages with driving tool via the third and fourth teeth-shaped members; and when the pressure inside the casing reaches a predetermined value, the shear pin is sheared and the driving tool together with the opening tool drives the inner tube to move downward to expose the sandblasting hole, so that a fracturing passage is established.

In one embodiment, a second closing tool comprising a central pull rod and a sixth teeth-shaped member connected to the central pull rod is further provided for closing the composite sleeve, wherein the second closing tool can be inserted into the inner tube or the tabular body of the opening tool, so that the sixth teeth-shaped member can be engaged with the first teeth-shaped member of the inner tube or the third teeth-shaped member of the opening tool, whereby the inner tube can be moved upward via lifting the second closing tool, thus re-blocking the sandblasting hole so as to close the fracturing passage.

In one embodiment, a position-selecting groove and a position-selecting member are provided in respective fitting surfaces of the inner tube and the outer tube of the composite sleeve, and are disposed at different positions when the sleeve fracturing assembly is in an open state and when the fracturing passage is closed. That the position-selecting groove and position-selecting member are disposed at different positions in different states of the fracturing assembly can avoid a fluid action, and prevent the composite sleeve from being unexpectedly closed after the opening tool is taken out.

In one embodiment, the fitting surfaces of the outer tube and the inner tube of the composite sleeve are provided with corresponding positioning mechanisms that can be engaged with one another, so as to ensure that the inner tube engages with the outer tube so that the sandblasting hole is blocked and hence the fracturing passage is closed. The positioning mechanisms can ensure that the outer tube of the composite sleeve is separated from the inner tube thereof only when the opening tool and the driving tool are thrown in and pressure is applied, and that the outer tube of the composite sleeve can re-engage with the inner tube thereof to close the fracturing passage when the inner tube is lifted by the second closing tool.

According to the second aspect of the present disclosure, it further provides a sleeve fracturing device, comprising a plurality of the sleeve fracturing assemblies according to the second aspect of the present disclosure. The second and third teeth-shaped members of each opening tool are respectively configured as different from the second and third teeth-shaped members of any other opening tool, so that each opening tool can only engage with the inner tube and driving tool in the fracturing assembly associated with said opening tool. The sixth teeth-shaped member of each second closing tool is configured as different from the sixth teeth-shaped member of any other second closing tool, so that each second closing tool can only engage with the first teeth-shaped member of the inner tube or the third-teeth shaped member of the opening tool in the fracturing assembly associated with said second closing tool.

This configuration enables the second teeth-shaped member of the opening tool and the fourth teeth-shaped member of the driving tool associated with a specific fracturing assembly can only respectively engage with the first teeth-shaped member of the composite sleeve and the third-teeth shaped member of the opening tool in said fracturing assembly. Even when the opening tool or the driving tool is put down passing through other fracturing assemblies, the second teeth-shaped member of the opening tool or the fourth-teeth shaped member of the driving tool cannot radially move outward to form any engagement due to differences in the teeth-shaped members. Therefore, in the device according to the second aspect of the present disclosure, when a specific opening tool and driving tool are put down, only the corresponding composite sleeve can be opened, and when a specific second closing tool is put down, only the corresponding composite sleeve can be closed. That is, the sleeve fracturing device according to the present disclosure can selectively open and/or close specific composite sleeves as required.

In one embodiment, all the composite sleeves have the same inner diameter, which allows unlimited numbers of composite sleeves for unlimited numbers of staged fracturing.

In one embodiment, each teeth-shaped member can engage with the unique corresponding teeth-shaped member via unique contour parameters thereof and/or a guiding structure arranged thereon. In a preferred embodiment, the contour parameters are one or more selected from a group consisting of tooth number, tooth profile and teeth space.

In one embodiment, the sixth teeth-shaped member of the second closing tool is provided on an outer wall of the respective central pull rod with a fifth spring mechanism disposed between the central pull rod of the second closing tool and the sixth teeth-shaped member, wherein the sixth teeth-shaped member can move radially outward under the actuation of the fifth spring mechanism so as to engage with the first teeth-shaped member of the inner tube and the third teeth-shaped member of the opening tool.

In one embodiment, each of the spring mechanisms according to the second aspect of the present disclosure comprises an elastic member that can exert a radially outward force, and a limit stop for limiting the distance of the corresponding teeth-shaped member that can move circumferentially outward.

Elastic members of this kind enable the teeth-shaped member to automatically eject out when bumping against an engageable teeth-shaped member and to engage with the same, whereby the automatic engagement between and among the inner tube of the composite sleeve, the opening tool, the driving tool and the second closing tool in the well. The limit stop for limiting the distance that the teeth-shaped member outwardly move can not only ensure engagement between corresponding teeth-shaped members, but also prevent the teeth-shaped member from disengaging with the component to which the teeth-shaped member is connected, such as the through main body of the opening tool, the central body of the driving tool and the central pull rod of the second closing tool.

In one embodiment, the sixth teeth-shaped member of the second closing tool is a leaf spring member, a downstream end of which is connected to the respective central pull rod and an upstream end thereof is separated from the respective central pull rod. The second closing tool of sixth teeth shaped member in the form of the leaf spring member facilitates the manufacture and use of the second closing tool.

In one embodiment, each of the teeth-shaped members is provided with an inclined guiding structure at an upper end and a lower end thereof for guiding engagement or disengagement of the corresponding teeth-shaped member. This inclined guiding structure allows the engagement or disengagement of the corresponding teeth-shaped member to be achieved by being "pressed in" or "pressed out", facilitating the opening or closing operation of the composite sleeve.

In one embodiment, the main body of the driving tool comprises a through hollow structure with different sizes of cross sections, wherein a lower portion of the through hollow structure with a larger cross section is arranged with a pressureout mechanism, which cannot be disengaged from the lower portion of the through hollow structure, in particular cannot enter into the upper portion of the through hollow structure with a smaller cross section.

In a preferred embodiment, the pressureout mechanism comprises a cage and a sphere arranged inside the cage, wherein the cage comprises a sealed upper end, an open lower end, and a fluid passage on a circumferential wall of the cage, the sphere merely being capable of moving inside the cage without blocking the fluid passage on the circumferential wall of the cage when being disposed at the upper or lower end thereof.

The blocking function of the ball to the through hollow structure enables the driving tool of the through hollow structure to apply pressure in the wellbore. More importantly, when the sleeve fracturing device is used in a gas well, it is not necessary to take out the driving tool because the gas in the well would blow up the sphere to flow out through the fluid passage, which facilitates the operations. In a preferred embodiment, the fluid passage on the circumferential wall of the cage has a total area not less than the opening area at the lower end of the cage, which facilitates flow of the fluid.

In one embodiment, the opening tools of the fracturing assemblies connect to each other to form an opening tool string via a coupling mechanism, which comprises a shear pin and a setback pin. When the driving tool is coupled with the corresponding opening tool, the driving tool would force the setback pin aside and shear the shear pin, so that the corresponding opening tool is disengaged.

The second aspect of the present disclosure further relates to a method of using the sleeve fracturing device according to the second aspect of the present disclosure, comprising:

- Step I: mounting a pressure gradient opening mechanism at the lowest end of a casing or tubing string, and then successively mounting the composite sleeves in each fracturing assembly;
- Step II: connecting the opening tools of each fracturing assembly to form an opening tool string and putting down the same into the composite sleeve;
- Step III: applying pressure in the wellbore to open the pressure gradient opening mechanism at the lowest end and establishing a communication passage between the casing or tubing string with stratum; and
- Step IV: putting down the driving tools in sequence to open the composite sleeves from bottom to top for carrying out staged fracturing.

In one embodiment, Step V is further provided: recovering the opening tool and the driving tool through a fishing structure on the opening tool or merely recovering the driving tool through the fishing structure on the driving tool to restore the passage in the sleeve or tubing string. In another embodiment, when a specific fracturing passage needs to be closed, the second closing tool of the corresponding composite sleeve associated with said fracturing passage is put down so as to close the fracturing passage.

Since the opening tool, the driving tool, the second closing tool and the composite sleeve can merely achieve unique engagement, each time a driving tool is thrown down, only the corresponding opening tool can be separated from the opening tool string, so that said opening tool can be put down to a corresponding position to open the corresponding sleeve and establish a fracturing passage. At the same time, each second closing tool can only close one corresponding composite sleeve. Therefore, any composite sleeve of a horizontal or vertical well can be opened or closed, and thus staged fracturing can be achieved.

The present disclosure is advantageous over the prior art in that, in the sleeve fracturing devices according to the first or second aspect of the present disclosure, the composite sleeve can be opened or closed at any fixed position by the unique engagement between the teeth-shaped members. Particularly, when a specific composite sleeve needs to be opened, it is only necessary to put down the corresponding opening tool or a combination of opening tool and driving tool for opening said composite sleeve. On the other hand, when a specific sleeve or fracturing passage needs to be closed, it is only necessary to put down the corresponding first or second closing tool to close said sleeve or fracturing passage, without exerting an influence on any other composite sleeve or fracturing passage. The teeth-shaped members automatically engage or disengage with each other downhole through elastic actions thereof so as to achieve engagement or disengagement between and among the composite sleeve, the opening tool, the first or second closing tool and the driving tool according to the second aspect of the present disclosure, thereby facilitating the operations. Because all the composite sleeves have the same inner diameter, the number of composite sleeves of the present disclosure is not limited, whereby unlimited numbers of staged fracturing can be achieved. When the opening tool is taken out, the passage in the casing or tubing string can be all through, thus overcoming the defect in conventional fracturing where the yield and works such as post well logging would be affected due to retention of the starting ball in the casing or tubing string. Besides, the sleeve fracturing assembly, device and method of using the same according to the first or second aspect of the present disclosure can be applied not only in fracturing operations in horizontal oil well, but also in the field of stratum fracturing where opening and closing sleeves at fixed positions are required.

BRIEF DESCRIPTION OF DRAWINGS

In the following, the present disclosure will be explained in detail with reference to embodiments and appended drawings, wherein.

Figure 1A:
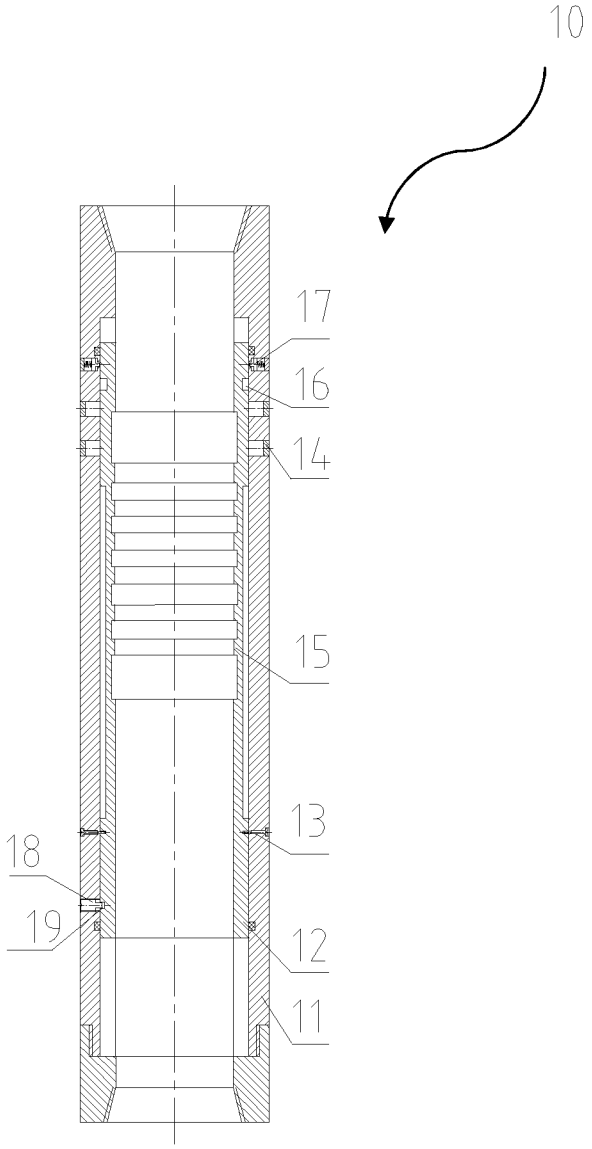
FIG. 1*a* is a schematic drawing of a composite sleeve of a sleeve fracturing assembly according to a first aspect of the present disclosure.

In the drawings, the same component is indicated by the same reference sign. The drawings are not drawn in accordance with an actual scale.

DETAILED DESCRIPTION OF EMBODIMENTS

A first aspect of the present disclosure will be explained in detail in the following with reference to FIGS. 1*a* to 11.

Figure 1B:
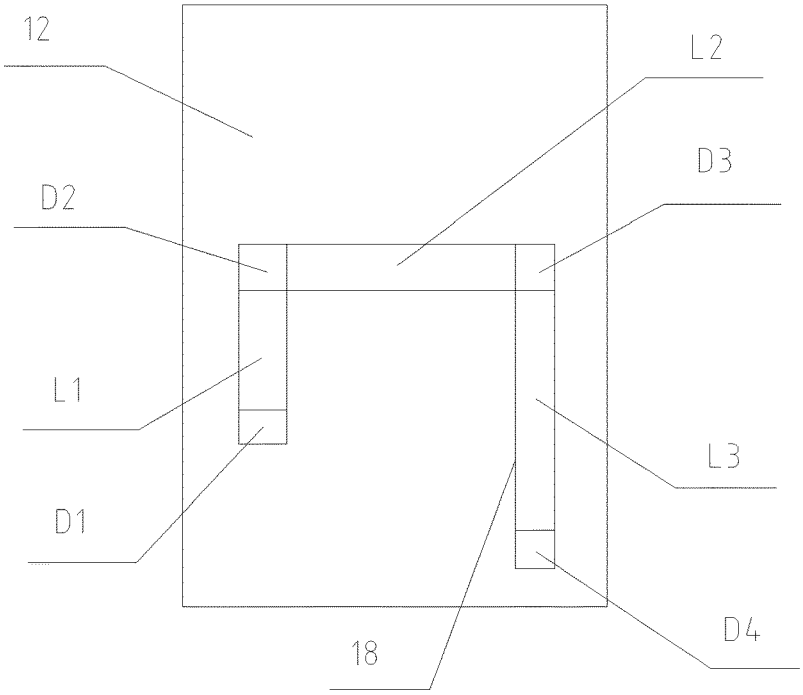
FIG. 1*b* is a schematic drawing showing a position-selecting groove in an inner tube of the composite sleeve as shown in FIG. 1*a;*

FIG. 1*a* illustrates a composite sleeve 10 of a sleeve fracturing assembly according to a first aspect of the present disclosure, comprising a fixed outer tube 11 and an inner tube 12 connected to an inner wall of the outer tube 11 via a shear pin 13, wherein the outer tube 11 is provided with a sandblasting hole 14 and an inner wall of the inner tube 12 is provided with a first teeth-shaped member 15. In the embodiment as indicated in FIG. 1*a*, the first teeth-shaped member 15 and the inner tube 12 form an integral piece. In one embodiment, the fitting surfaces of the outer tube 11 and the inner tube 12 are provided a positioning groove 16 and a positioning member 17. The positioning groove 16 and the positioning member 17 are configured as not being engaged with each other in an initial state as indicated in FIG. 1*a*, and only engaging with each other in closing a fracturing passage, thus ensuring that the outer tube 11 and the inner tube 12 can be engaged with each other, so as to ensure that the fracturing passage can be closed. In one embodiment, the positioning member 17 and the positioning groove 16, for example, can be respectively in the form of a setback pin and a pin groove. In another embodiment, the fitting surfaces of the outer tube 11 and the inner tube 12 are further provided with a position-selecting groove 19 and a position-selecting member 18. The position-selecting groove 19 comprises a first part L1 and a third part L3 circumferentially spaced with each other along an axial direction of the composite sleeve 10, wherein the third part L3 is longer than the first part L1 and an upstream end of the third part L3 is aligned with an upstream end of the first part L1. A second part L2 connects the ends of the first part L1 and the third part L3 that are aligned with each other to form the position-selecting groove 19, as shown in FIG. 1*b*. In opening or closing the composite sleeve, the position-selecting member 18 can move along the position-selecting groove 19 as shown in FIG. 1*b*.

Figure 2A:
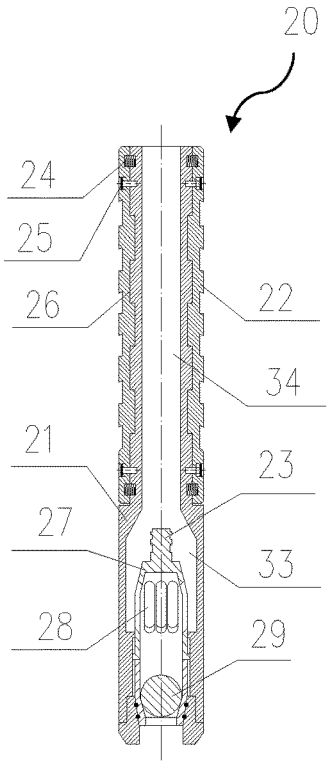
FIGS. 2*a*, 2*b* and 2*c* are schematic drawings showing an opening tool of the sleeve fracturing assembly according to the first aspect of the present disclosure.

FIG. 2*a* shows a first embodiment of an opening tool 20 of the sleeve fracturing assembly according to the first aspect of the present disclosure, comprising a main body 21 and a second teeth-shaped member 22 connected to an outer wall of the main body 21 via a third spring mechanism which can drive the second-teeth shaped member 22 radially outward. In one embodiment, as shown in FIG. 2, the third spring mechanism comprises a spring 24 for driving the second teeth-shaped member 22 to move outward and a limit screw 25 for limiting the distance of the second teeth-shaped member 22 that can move circumferentially outward. The limit screw 25 is not only used for limiting the distance of the second teeth-shaped member that can move outward, but also used for allowing the second teeth-shaped member 22 to always connect to the main body 21. Preferably, two ends of the third spring mechanism close to the second teeth-shaped member 22 are both arranged with the spring 24 and the limit screw 25. In another optional embodiment, a structure 26 of a projection and a recess coupled with each other is further provided between the second teeth-shaped member 22 and the main body 21. Preferably, when the second teeth-shaped member 22 moves outward, the structure of the projection and the recess still exists between the second teeth-shaped member 22 and the main body 21, thus improving the connection strength between the second teeth-shaped member 22 and the main body 21.

Figure 8:
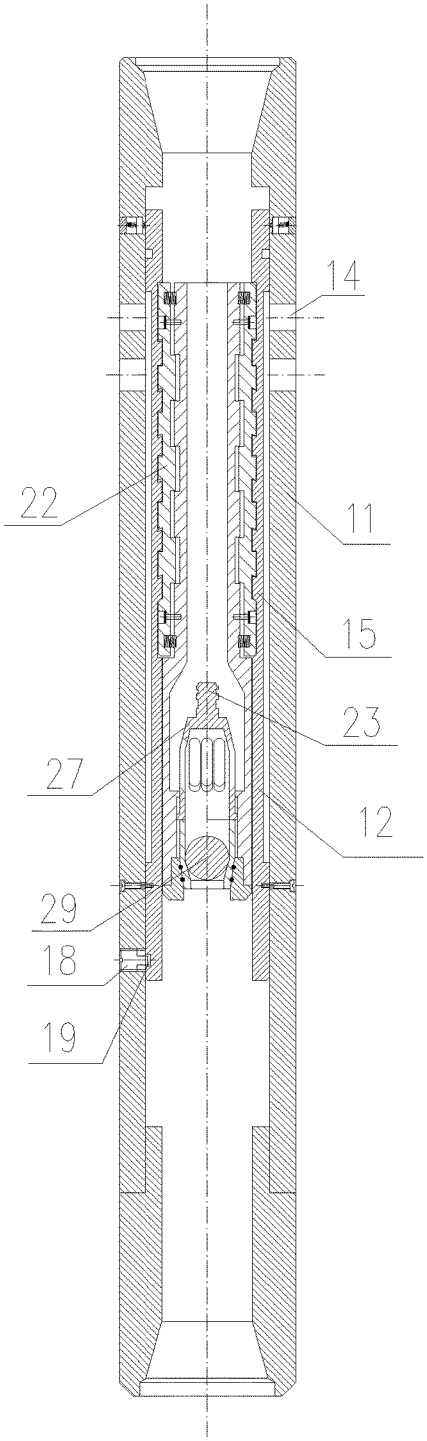
FIG. 8 is a schematic drawing showing the positional relationship between the composite sleeve according to the first aspect of the present disclosure and the opening tool as indicated in FIG. 2*a;*
Figure 9:
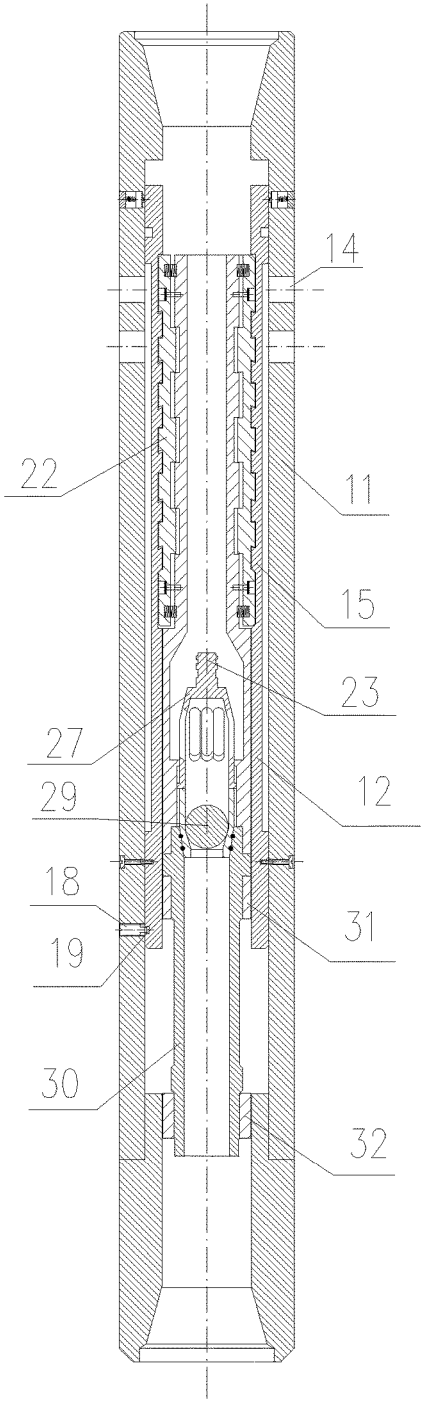
FIG. 9 is a schematic drawing showing the positional relationship between the composite sleeve according to the first aspect of the present disclosure and the opening tool as indicated in FIG. 2*b;*

In an initial state of the sleeve fracturing assembly, the inner tube 12 and outer tube 11 of the composite sleeve 10 are connected to each other via the shear pin 13, and the position-selecting groove 19 and the position-selecting member 18 are engaged at position D1 of the position-selecting groove 19. At this time, the inner tube 12 completely covers the sandblasting hole 14, and the positioning groove 16 is below the positioning member 17 without being engaged with each other, as shown in FIG. 1*a*. When the opening tool 20 as shown in FIG. 2*a* is put down, the inner tube 12 of the composite sleeve 10 and the opening tool 20 are coupled via the first teeth-shaped member 15 and the second teeth-shaped member 22, as illustrated in FIG. 8. When the pressure inside the casing or tubing string reaches a predetermined value, the shear pin 13 is sheared and the opening tool 20 drives the inner tube 12 to move downward to expose the sandblasting hole 14, whereby a fracturing passage is established. Meanwhile, the position-selecting groove 19 and the position-selecting member 18 are engaged at position D2 of the position-selecting groove 19.

Figure 2B:
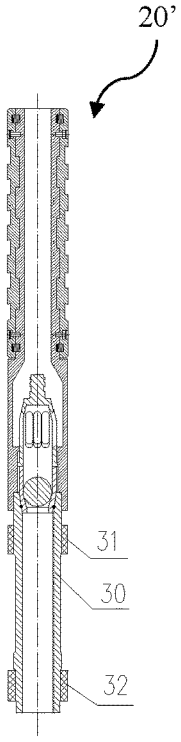

FIG. 2*b* shows a second embodiment of an opening tool 20' of the sleeve fracturing assembly according to the first aspect of the present disclosure. The opening tool 20' comprises all the components as shown in FIG. 2*a* and further comprises a guide mechanism 30. After the opening tool and the inner tube of the composite sleeve are engaged, when a pressure is applied, the guide mechanism 30 can enable the opening tool and the inner tube of the composite sleeve to move with higher stability. In a preferred embodiment, sealing members are arranged on the contacting surfaces of the guide mechanism 30 with the inner tube 12 and outer tube 11 of the composite sleeve 10, as indicated by reference signs 31 and 32 in FIGS. 2*b* and 9, in order to prevent leakage of pressurized fluid and thus improve the working efficiency.

Figure 2C:
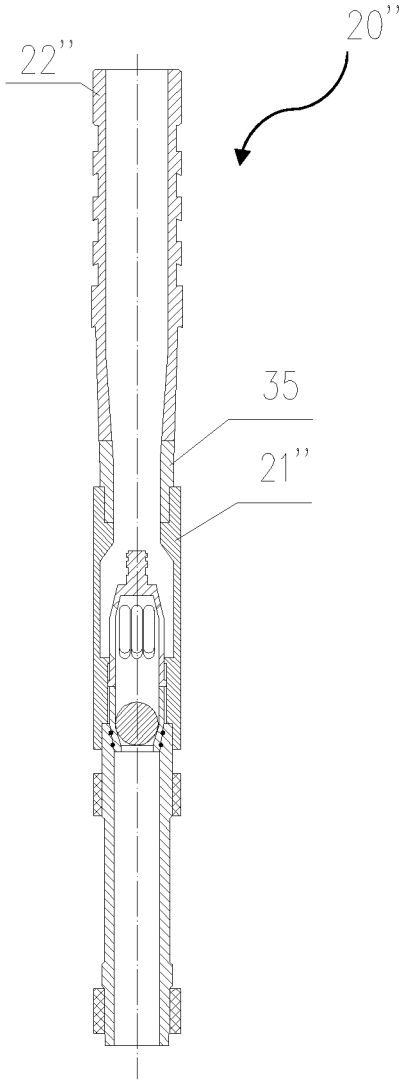
Figure 3:
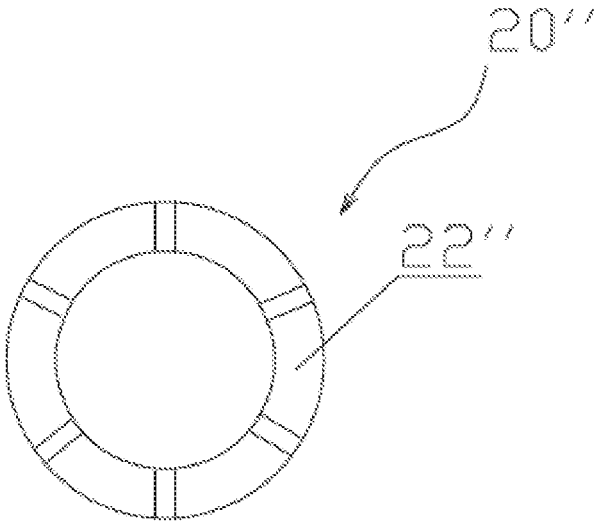
FIG. 3 is a top view of the opening tool of the sleeve fracturing assembly as shown in FIG. 2*c;*

FIG. 2*c* indicates a third embodiment of an opening tool 20" of the sleeve fracturing assembly according to the first aspect of the present disclosure. This embodiment differs from FIGS. 2*a* and 2*b* only in that a plurality of second teeth-shaped members 22" are connected to an upper end of a main body 21" via elastic members 35, such as leaf spring members. One end of these elastic members 35 connecting to the main body 21" has a smaller diameter than the other end thereof connecting to the second teeth-shaped members 22". FIG. 3 is a top view of the opening tool 20" as shown in FIG. 2*c*. FIG. 3 shows that the opening tool 20" comprises a plurality of second teeth-shaped members 22" forming a cylinder, which makes it easier for the manufacture of the opening tool 20".

In one embodiment, the opening tool 20 has a through hollow structure with different sizes of cross sections. As shown from FIGS. 2*a* to 2*c*, the through hollow structure of the opening tool 20 comprises, for example, two portions, i.e., a lower portion 33 with a larger size and an upper portion 34 with a smaller size. The opening size of the lower portion 33 as a whole gradually decreases towards a downstream direction, i.e., in a form of a cone with its smaller end towards the downstream direction. With this arrangement, a pressureout mechanism disposed in the lower portion 33 cannot be disengaged therefrom.

As shown from FIGS. 2*a* to 2*c*, the pressureout mechanism comprises a cage 27 and a sphere 29 arranged inside the cage 27. The cage 27 comprises an open lower end, a sealed upper end with a fishing handle 23 at an outer side thereof, and a fluid passage 28 on a circumferential wall of the cage 27. In one embodiment, the cage 27 has an outer diameter lager than the upper portion 34 of the through hollow structure and also larger than the opening of the lower portion 33. Therefore, the cage 27 will not disengage from the lower portion 33. In one specific embodiment, a lower opening of the cage 27 forms a conical structure that can match with the conical opening of the lower portion 33 of the through hollow structure, so that the cage 27 will not disengage from the lower portion 33. The sphere 29 has a diameter larger than the lower opening of the cage 27, whereby the sphere 29 will not disengage from the cage 27 and will seal the casing to achieve pressureout when pressure is applied to the casing. Preferably, when the sphere 29 is at the upper and lower ends of the cage 27, the sphere 29 will not block the fluid passage 28 on the circumferential wall of the cage 27. In a preferred embodiment, the opening area at the lower end of the cage 27 is smaller than or equal to the total area of the fluid passage 28 on the circumferential wall of the cage 27.

Figure 4A:
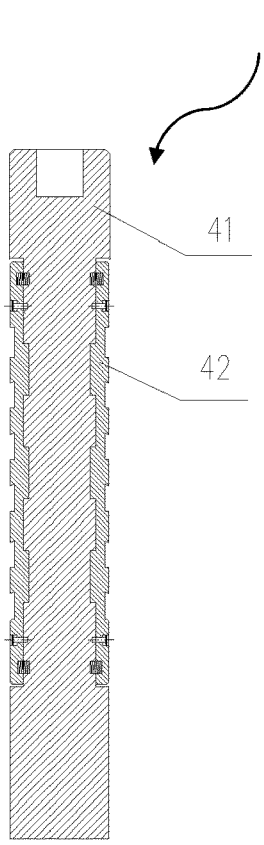
FIGS. 4*a* and 4*b* are schematic drawings of a first closing tool of the sleeve fracturing assembly according to the first aspect of the present disclosure.

FIG. 4*a* schematically shows a first embodiment of a first closing tool 40 of the sleeve fracturing assembly according to the first aspect of the present disclosure. The first closing tool 40 comprises a central pull rod 41, a fifth teeth-shaped member 42 arranged on an outer wall of the central pull rod 41 and a fourth spring mechanism disposed between the central pull rod 41 and the fifth teeth-shaped member 42. The fourth spring mechanism is identical to the third spring mechanism of the opening tool 20 as shown in FIG. 2*a* and thus will not be repeatedly described here for the sake of simplicity. Similarly with the opening tool 20, a structure with a projection and a recess coupled with each other is also provided between the fifth teeth-shaped member 42 of the first closing tool 40 and the central pull rod 41. This structure is of the same function as the projection and recess of the opening tool 20 and thus for the sake of simplicity will not be repeatedly described here, either. Under the actuation of elasticity, the fifth teeth-shaped member 42 can automatically engage with the inner tube 12 of the corresponding composite sleeve 10, which facilitates the subsequent closing of the fracturing passage.

Figure 4B:
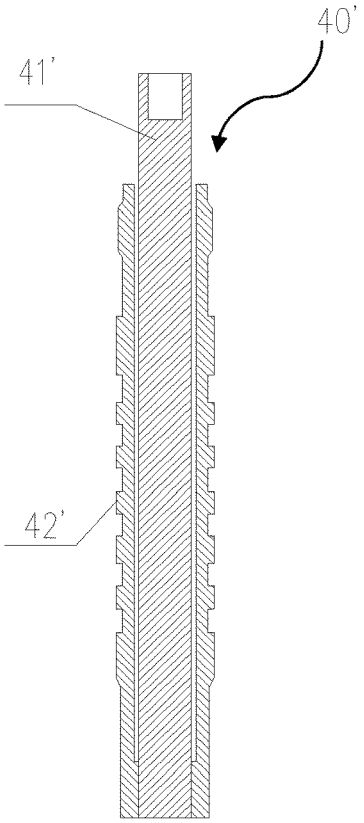

FIG. 4*b* schematically shows a second embodiment of a first closing tool 40' of the sleeve fracturing assembly according to the first aspect of the present disclosure. The first closing tool 40' comprises a central pull rod 41' and a fifth teeth-shaped member 42' in the form of a leaf spring member, wherein the fifth teeth-shaped member 42' connects to the central pull rod 41' only at a lower end thereof with an upper end spaced from the central pull rod 41' for a certain distance. In use, the fifth teeth-shaped member 42', under an elastic actuation thereof, can automatically engage with the inner tube 12 of the composite sleeve, which facilitates the subsequent closing of the fracturing passage.

Figure 7:
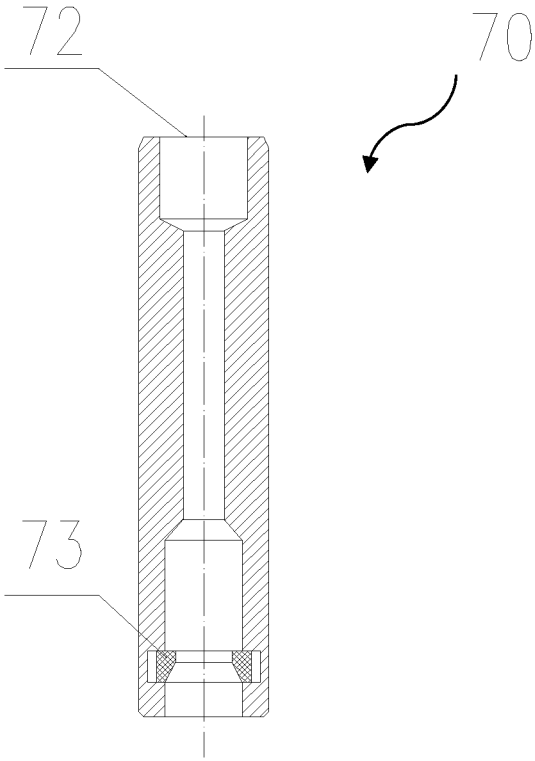
FIG. 7 is a schematic drawing of a fishing tool of the sleeve fracturing assembly according to the first aspect of the present disclosure.
Figure 10:
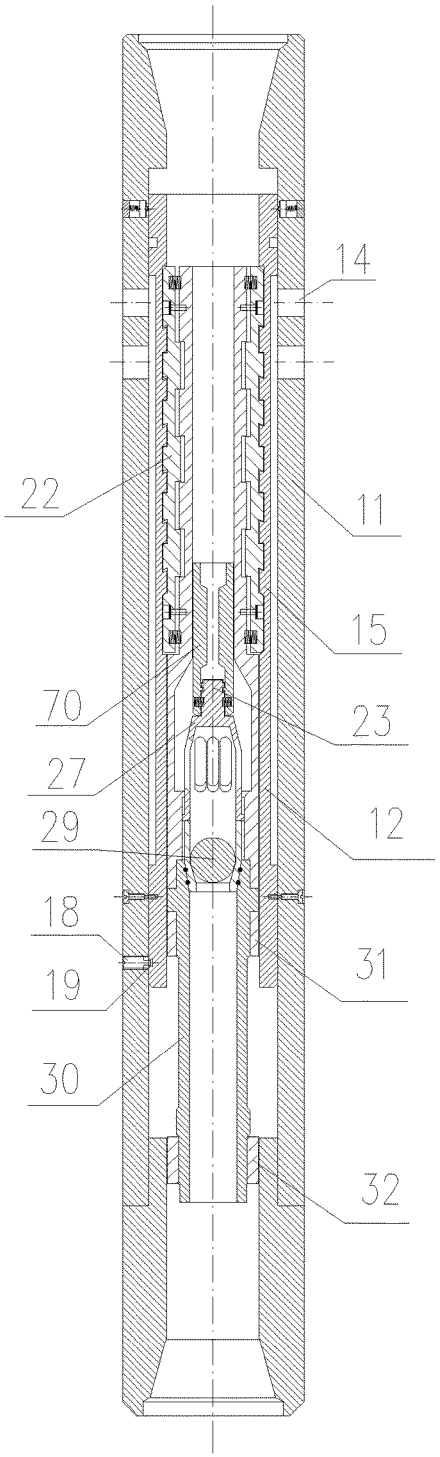
FIG. 10 is a schematic drawing showing the positional relationship between the composite sleeve according to the first aspect of the present disclosure and the opening tool and fishing tool as indicated in FIG. 2*b*.

FIG. 7 is a schematic drawing of a fishing tool 70 according to the first aspect of the present disclosure, which can be inserted into the through hollow structure of the above-mentioned opening tool. A lower end of the fishing tool 70 is provided with a fishing head 73, such as a snap ring, so as to catch the fishing handle 23 on the cage 27 of the opening tool 20, the engagement of which is schematically shown in FIG. 10. An upper end 72 of the fishing tool 70 can be connected to the tubing string (not shown), so as to drag the tubing string to drive the fishing tool and pull the opening tool out of the composite sleeve.

Figure 11:
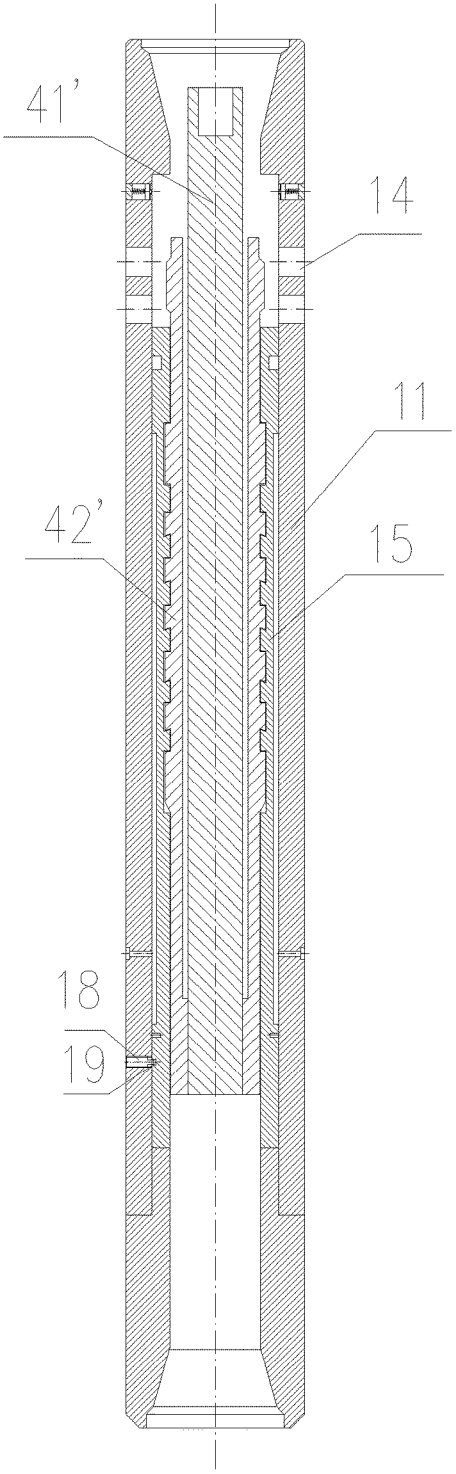
FIG. 11 is a schematic drawing showing the positional relationship between the composite sleeve and the first closing tool according to the first aspect of the present disclosure.

In the following a process of closing the fracturing passage will be illustrated with reference to the first closing tool 40' as shown in FIG. 4*b*. First, the fishing tool 70 is put down to fish the opening tool 20 from in composite sleeve 10. Next, the corresponding first closing tool 40' is put down to the sleeve, and the fifth teeth-shaped member 42' is engaged with the first teeth-shaped member 15 of the inner tube 12 of the composite sleeve 10, as shown in FIG. 11. After that, the first closing tool 40' is rotated to drive the inner tube 12 to rotate, until the position-selecting groove 19 is coupled with the position-selecting member 18 at position D3. The central pull rod 41' of the first closing tool 40' is lifted, so that the positioning groove 16 and the positioning member 17 will be engaged with each other when the position-selecting groove 19 couples with the position-selecting member 18 at position D4. At this time, the sandblasting hole 14 is blocked by the inner tube 12, so that the composite sleeve 10 and the fracturing passage can be closed. This being the case, the composite sleeve 10 can be avoided from being unexpectedly closed after the opening tool is taken out.

Figure 5:
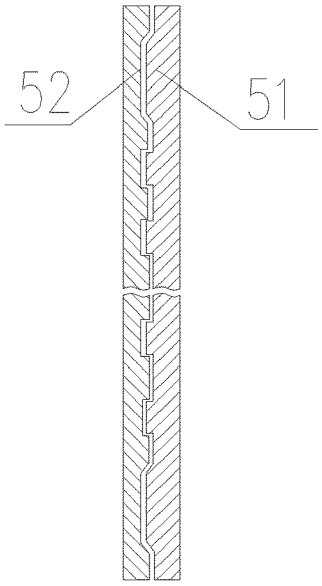
FIG. 5 is a schematic drawing of a guiding structure of a teeth-shaped member according to the first aspect of the present disclosure.

In a preferred embodiment, each of the teeth-shaped members according to the first aspect of the present disclosure has an inclined guiding structure or a sloping guiding structure at an end thereof, as schematically shown in FIG. 5 by reference sign 51. This guiding structure can promote one teeth-shaped member to be "pressed into" and/or "pressed out from" another teeth-shaped member engaged with said teeth-shaped member, thus facilitating the operation.

A sleeve fracturing device according to the first aspect of the present disclosure comprises a plurality of sleeve fracturing assemblies in accordance with the first aspect of the present disclosure. Each composite sleeve is configured that the first teeth-shaped member thereof is different from the first teeth-shaped member of any other composite sleeve, so that each composite sleeve can only be engaged with a single opening tool, i.e., the opening tool in the sleeve assembly associated with said composite sleeve, and that each composite sleeve can only be engaged with a single first closing tool, i.e., the first closing tool in the sleeve assembly associated with said composite sleeve.

Before the opening tool as shown in FIGS. 2*a* and 2*b* is put down, the second teeth-shaped member of the opening tool projects out of the main body under the actuation of the spring and the limit screw of the third spring mechanism. As the opening tool is putting down, the second teeth-shaped member will not pop eject out due to the pressing action from the inner tubes of other composite sleeves before being engaged with the first teeth-shaped member of the sleeve assembly associated with said second teeth-shaped member. The second teeth-shaped member will not eject out from the main body of the opening tool under the actuation of the spring to be engaged with the first teeth-shaped member of the sleeve assembly until said opening tool reaches the first teeth-shaped member of the sleeve assembly associated with said opening tool.

Before the opening tool as shown in FIGS. 2*a* and 2*b* is put down, the second teeth-shaped member of the opening tool projects out of the main body under the actuation of the spring and the limit screw of the third spring mechanism. As the opening tool is putting down, the second teeth-shaped member will not be ejected out due to the pressing action from the inner tubes of other composite sleeves before being engaged with the first teeth-shaped member of the sleeve assembly associated with said second teeth-shaped member. The second teeth-shaped member will not eject out from the main body of the opening tool under the actuation of the spring to be engaged with the first teeth-shaped member of the sleeve assembly until said opening tool reaches the first teeth-shaped member of the sleeve assembly associated with said opening tool.

It can be easily understood that the fifth teeth-shaped member of the first closing tool engages with the first teeth-shaped member of the composite sleeve in the same way, thereby achieving the operation similar to "opening different locks with different keys".

Figure 6A:
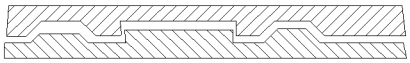
FIGS. 6*a* to 6*c* are schematic drawings showing the principle of unique engagement between and among the teeth-shaped members according to the first aspect of the present disclosure.
Figure 6B:
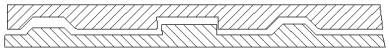
Figure 6C:
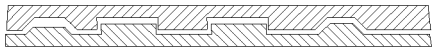

FIGS. 6*a* to 6*c* schematically illustrate how each teeth-shaped member is engaged with a unique corresponding teeth-shaped member. Each teeth-shaped member engages with the unique corresponding teeth-shaped member via unique contour parameters thereof, which, for example, can be one or more selected from the group consisting of tooth profile as shown in FIG. 6*a*, teeth space as shown in FIG. 6*b* and tooth number as shown in FIG. 6*c*. Preferably, a guiding structure 51 on each teeth-shaped member can also be configured as only capable of engaging with one single corresponding structure 52, whereby each teeth-shaped member achieves engagement with one single corresponding teeth-shaped member, as schematically indicated in FIG. 5. It is easily understood, the contour parameters of the teeth-shaped member can be used in combination with the guiding structure. Preferably, a side surface and bottom surface of at least one tooth and/or tooth space of the teeth-shaped member form an angle of 90 degrees or less than 90 degrees, i.e., form a rectangular tooth or hook tooth, so that the teeth-shaped members can be stably engaged without being separated from each other under excessive forces.

According to the first aspect of the present disclosure, the contour parameters one teeth-shaped member and/or guiding structure thereof should be configured as enabling the teeth-shaped member to identify the unique corresponding teeth-shaped member associated with said teeth-shaped member. When the contour parameters and/or guiding structure of one teeth-shaped member completely match with those of another teeth-shaped member, either of the teeth-shaped members will engage with and enter into the other teeth-shaped member under an elastic force, so that the two corresponding tools are coupled with each other to open or close the composite sleeve, whereby the composite sleeve can be opened or closed at any fixed position.

In the following a fracturing process with the sleeve fracturing device according to the first aspect of the present disclosure will be descried with reference to FIGS. 1*a* to 11. First, a pressure gradient opening mechanism is mounted at the lowest end of the casing or tubing string before successively mounting the composite sleeves in each fracturing assembly according to the first aspect of the present disclosure. In one embodiment, the pressure gradient opening mechanism can adopt a pressure gradient sleeve or a sandblasting hole that is well known in the prior art. And then, pressure is applied in the wellbore to open the pressure gradient opening mechanism at the lowest end, so as to establish a communication passage between the casing or tubing string with stratum. Subsequently, each of the opening tools is put down in sequence to open the composite sleeves from bottom to top for carrying out staged fracturing.

After the staged fracturing is completed, each opening tool is fished out from top to bottom with the fishing tool 70 and the oil or gas passage in the sleeve or tubing string is restored. When a specific fracturing passage needs to be closed, the first closing tool associated with the sleeve associated with said fracturing passage is put down and the sleeve is closed according to the process described in the first aspect of the present disclosure about the first closing tool, whereby the specific fracturing passage is closed.

A second aspect of the present disclosure will be explained in detail in the following with reference to FIGS. 12*a* to 20.

Figure 12A:
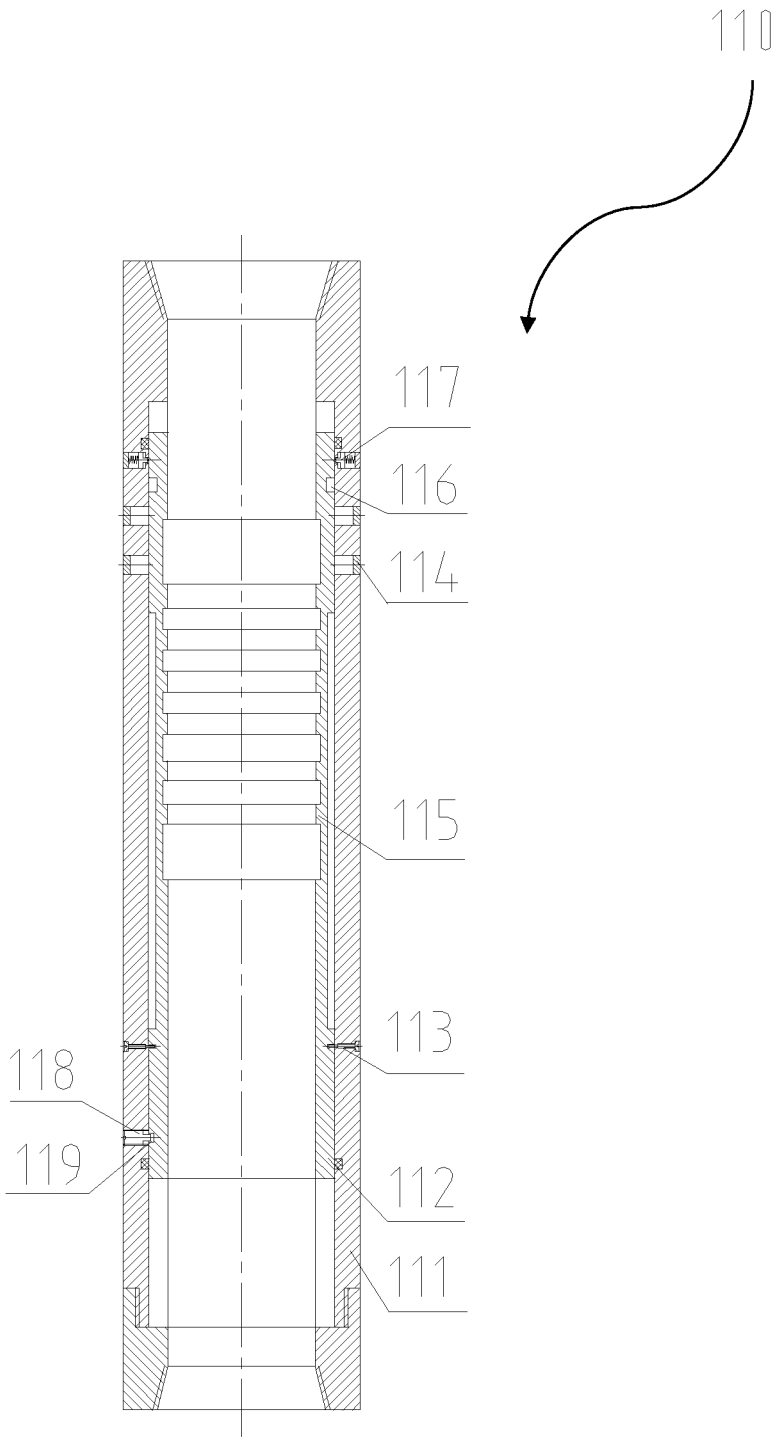
FIG. 12*a* is a schematic drawing of a composite sleeve of a sleeve fracturing assembly according to a second aspect of the present disclosure.
Figure 12B:
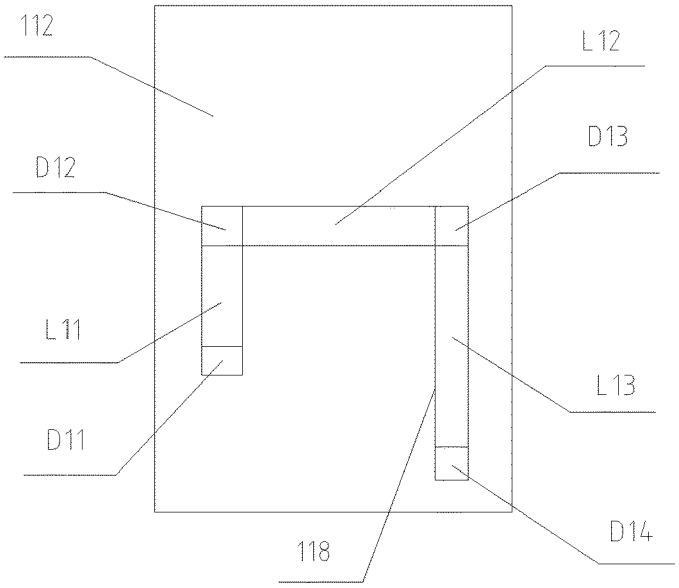
FIG. 12*b* is a schematic drawing showing a position-selecting groove in an inner tube of the composite sleeve according to FIG. 12*a;*

FIG. 12*a* illustrates a composite sleeve 110 of a sleeve fracturing assembly according to a second aspect of the present disclosure, comprising a fixed outer tube 111 and an inner tube 112 connected an inner wall of the outer tube 111 via a shear pin 113, wherein the outer tube 111 is provided with a sandblasting hole 114 and an inner wall of the inner tube 112 is provided with a first teeth-shaped member 115. In the embodiment as indicated in FIG. 12*a*, the first teeth-shaped member 115 and the inner tube 112 form an integral piece. In one embodiment, the fitting surfaces of the outer tube 111 and the inner tube 112 are provided a positioning groove 116 and a positioning member 117. The positioning groove 116 and the positioning member 117 are configured as not being engaged with each other in an initial state as indicated in FIG. 12*a*, and only engaging with each other in closing a fracturing passage, thus ensuring that the outer tube 111 and the inner tube 112 can be engaged with each other, so as to ensure that the fracturing passage can be closed. In one embodiment, the positioning member 117 and the positioning groove 116, for example, can adopt respectively in the form of a setback pin and a pin groove. In another embodiment, the fitting surfaces of the outer tube 111 and the inner tube 112 are further provided with a position-selecting groove 119 and a position-selecting member 118. The position-selecting groove 119 comprises a first part L11 and a third part L13 circumferentially spaced with each other along an axial direction of the composite sleeve 110, wherein the third part L13 is longer than the first part L11 and an upstream end of the third part L13 is aligned with an upstream end of the first part L11. A second part L12 connects the ends of the first part L11 and the third part L13 that are aligned to each other to form the position-selecting groove 119, as shown in FIG. 12*b*. In opening or closing the composite sleeve, the position-selecting member 118 can move along the position-selecting groove 119 as shown in FIG. 12*b*.

Figure 13:
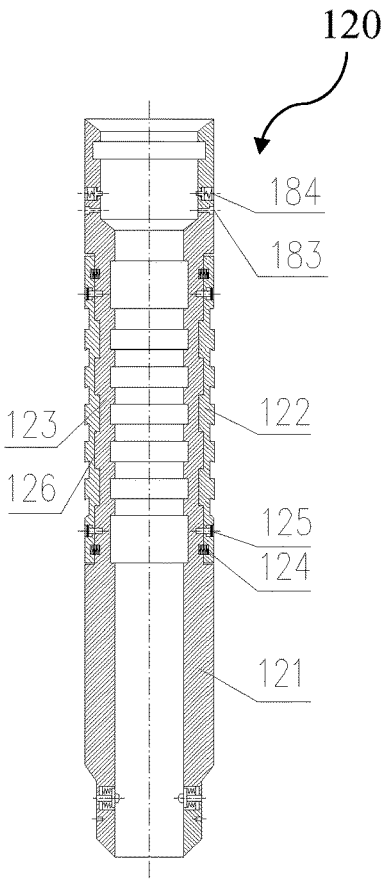
FIG. 13 is a schematic drawing showing an opening tool of the sleeve fracturing assembly according to the second aspect of the present disclosure.

FIG. 13 shows an opening tool 120 of the sleeve fracturing assembly according to the second aspect of the present disclosure, comprising a hollow tabular main body 121, a third teeth-shaped member 123 forming an integral piece with the main body 121, and a second teeth-shaped member 122 connected to an outer wall of the main body 121 via a first spring mechanism which can drive the second-teeth shaped member 122 radially outward. In one embodiment, the first spring mechanism comprises a spring 124 for driving the second teeth-shaped member 122 to move outward and a limit screw 125 for limiting the distance of the second teeth-shaped member 122 that can move radially outward. As shown in FIG. 13, two ends of the first spring mechanism close to the second teeth-shaped member 122 are both arranged with the spring 124 and the limit screw 125. The limit screw 125 is not only used for limiting the distance of the second teeth-shaped member 122 that can move outward, but also used for allowing the second teeth-shaped member 122 to always connect to the main body 121. In another optional embodiment, a structure 126 of a projection and a recess coupled with each other is further provided between the second teeth-shaped member 122 and the main body 121. Preferably, when the second teeth-shaped member 122 moves outward, the structure of the projection and the recess still exists between the second teeth-shaped member 122 and the main body 121, thus improving the connection strength between the second teeth-shaped member 122 and the main body 121.

Figure 14:
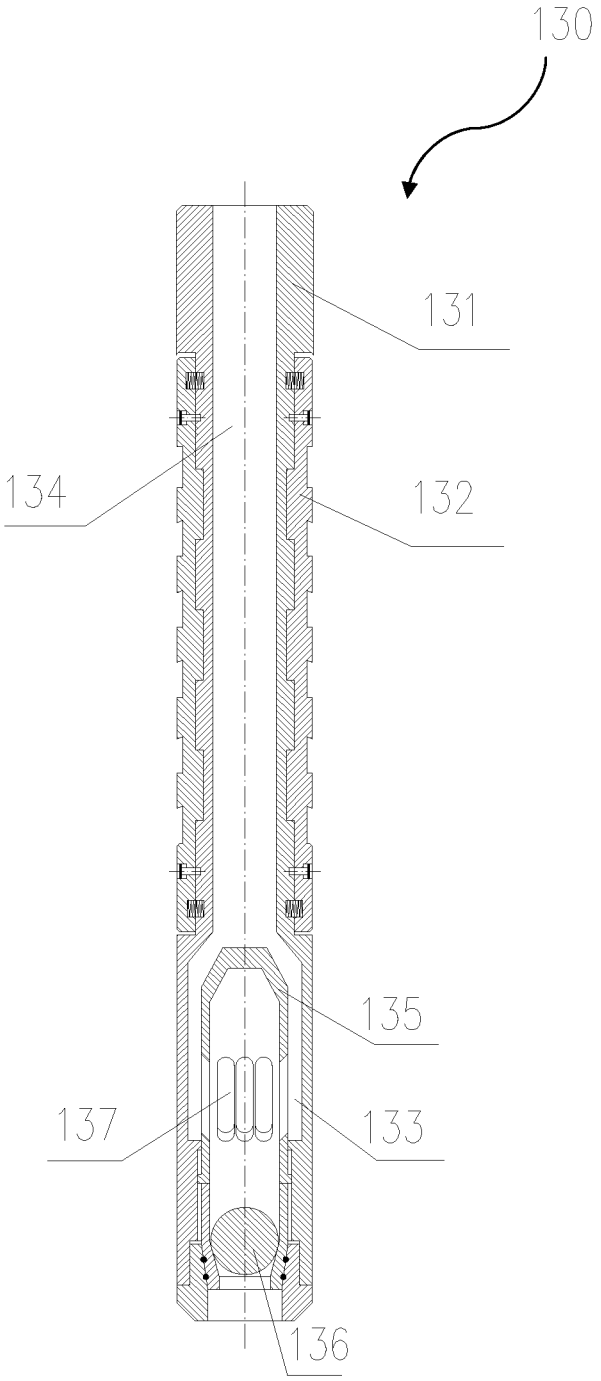
FIG. 14 is a schematic drawing showing a driving tool of the sleeve fracturing assembly according to the second aspect of the present disclosure.

FIG. 14 shows a driving tool 130 of the sleeve fracturing assembly according to the second aspect of the present disclosure, comprising a central body 131, a fourth teeth-shaped member 132 arranged on an outer wall of the central body 131 and a second spring mechanism disposed between the central body 131 and the fourth teeth-shaped member 132. The second spring mechanism can adopt exactly the same structure as the first spring mechanism of the opening tool 120 and thus will not be repeatedly described here for the sake of simplicity. Similarly with the opening tool 120, a structure of a projection and a recess coupled with each other is also disposed between the fourth teeth-shaped member 132 and the central body 131, the function of which is the same as the structure of the projection and recess of the opening tool 120 and therefore, for the sake of simplicity will not be repeatedly described here, either.

In an initial state of the sleeve fracturing assembly, the inner tube 112 and outer tube 111 of the composite sleeve 110 are connected to each other via the shear pin 113, and the position-selecting groove 119 and the position-selecting member 118 are engaged at position D11 of the position-selecting groove 119. At this time, the inner tube 112 completely covers the sandblasting hole 114, and the positioning groove 116 is below the positioning member 117 without being engaged with each other, as shown in FIG. 12*a*. When the opening tool 120 and the driving tool 130 are successively put down, the inner tube 112 of the composite sleeve 110 and the opening tool 120 are coupled via the first teeth-shaped member 115 and the second teeth-shaped member 122, and the opening tool 120 engages with the driving tool 130 via the third teeth-shaped member 123 and the fourth teeth-shaped member 132. When the pressure inside the casing or tubing string reaches a predetermined value, the shear pin 113 is sheared and the driving tool 130 together with the opening tool 120 drives the inner tube 112 to move downward to expose the sandblasting hole 114, whereby a fracturing passage is established. At the same time, the position-selecting groove 119 and the position-selecting member 118 are engaged at position D12 of the position-selecting groove 119.

Figure 15A:
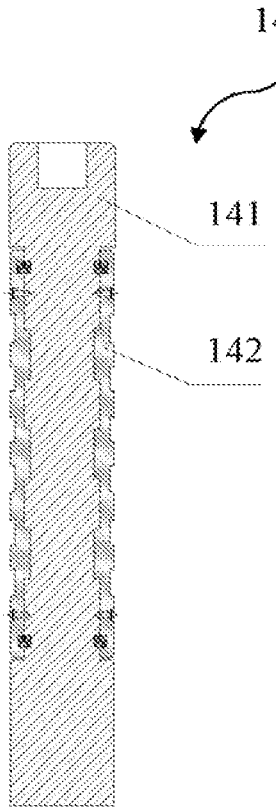
FIGS. 15*a* and 15*b* are schematic drawings of a second closing tool of the sleeve fracturing assembly according to the second aspect of the present disclosure.

FIG. 15*a* schematically shows a first embodiment of a second closing tool 140 of the sleeve fracturing assembly according to the second aspect of the present disclosure. The second closing tool 140 comprises a central pull rod 141, a sixth teeth-shaped member 142 arranged on an outer wall of the central pull rod 141 and a fifth spring mechanism disposed between the central pull rod 141 and the sixth teeth-shaped member 142. The fifth spring mechanism is identical to the first spring mechanism of the opening tool 120 and thus will not be repeatedly described here for the sake of simplicity. Similarly with the opening tool 120, a structure of a projection and a recess coupled with each other is also provided between the sixth teeth-shaped member 142 and the central pull rod 141. This structure is of the same function as the projection and recess of the opening tool 120 and thus for the sake of simplicity will not be repeatedly described here, either. Under the actuation of elasticity, the sixth teeth-shaped member 142 can automatically engage with the inner tube 112 of the corresponding composite sleeve downhole, which facilitates the subsequent closing of the fracturing passage.

Figure 15B:
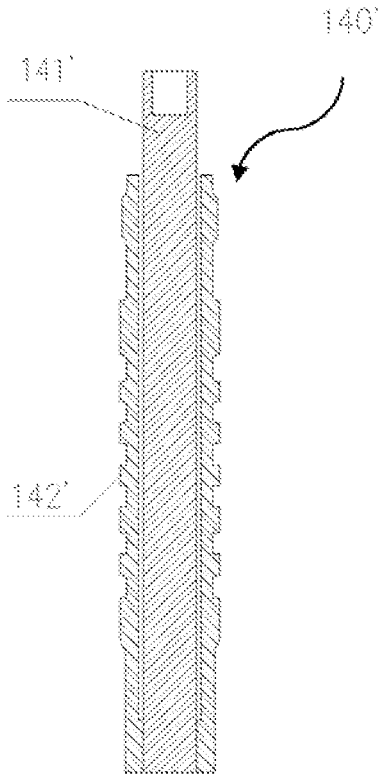

FIG. 15*b* schematically shows a second embodiment of a second closing tool 140' of the sleeve fracturing assembly according to the second aspect of the present disclosure. The second closing tool 140' comprises a central pull rod 141' and a sixth teeth-shaped member 142' in the form of a leaf spring member, wherein the sixth teeth-shaped member 142' connects to the central pull rod 141' only at a lower end thereof with an upper end spaced from the central pull rod 141' for a certain distance. In use, the sixth teeth-shaped member 142', under an elastic actuation thereof, can automatically engage with the inner tube 112 of the composite sleeve, which facilitates the subsequent closing of the fracturing passage.

Before the fracturing passage is closed, the driving tool 130 is first fished out from the opening tool 120, or the opening tool 120 and the driving tool 130 are fished out from the composite sleeve 110. In the following a process of closing the fracturing passage will be illustrated with reference to the second closing tool 140' as shown in FIG. 15*b*, wherein the second closing tool 140' can be inserted into the inner tube 112 of the composite sleeve 110. To start with, the opening tool 120 and the driving tool 130 are fished out from the composite sleeve 110. Next, the corresponding second closing tool 140' is put down into the sleeve, so as to engage the sixth teeth-shaped member 142' with the first teeth-shaped member 115 in the inner tube 112 of the composite sleeve. After that, the second closing tool 140' is rotated to drive the inner tube 112 to rotate, until the position-selecting groove 119 is coupled with the position-selecting member 118 at position D13. The central pull rod 141' of the second closing tool 140' is lifted, so that the positioning groove 116 and the positioning member 117 will be engaged with each other when the position-selecting groove 119 couples with the position-selecting member 118 at position D14. At this time, the sandblasting hole 114 is blocked by the inner tube 112, so that the composite sleeve 110 and the fracturing passage can be closed. This being the case, the composite sleeve 110 can be avoided from being unexpectedly closed after the opening tool or the driving tool as mentioned above is taken out.

In a preferred embodiment, each of the teeth-shaped members according to the second aspect of the present disclosure has an inclined guiding structure or a sloping guiding structure at an end thereof, as schematically shown in FIG. 5 by reference sign 151. This guiding structure can promote one teeth-shaped member to be "pressed into" and/or "pressed out from" another teeth-shaped member engaged with said teeth-shaped member, thus facilitating the operation.

In one embodiment, the driving tool 130 comprises a through hollow structure with different sizes of cross sections. As shown in FIG. 14, the through hollow structure of the driving tool 130 can, for example, comprise two portions, i.e., a downstream portion 133 with a larger size and an upstream portion 134 with a smaller size. The opening size of the downstream portion 133 as a whole gradually decreases towards a downstream direction, i.e., in a form of a cone with a smaller end thereof towards the downstream direction. With this arrangement, a pressureout mechanism disposed in the downstream portion 133 cannot be disengaged therefrom.

In one embodiment, the pressureout mechanism comprises a cage 135 and a sphere 136 arranged inside the cage 135. The cage 135 comprises a sealed upper end, an open lower end, and a fluid passage 137 on a circumferential wall thereof. As shown in FIG. 14, the cage 135 has an outer diameter lager than the upstream portion 134 of the through hollow structure and also larger than the opening of the downstream portion 133. Therefore, the cage 135 will not disengage from the downstream portion 133. In one embodiment, a downstream end opening of the cage 135 forms a conical structure that can match with the conical opening of the downstream portion 133 of the through hollow structure, so that the cage 135 will not disengage from the downstream portion 133. The sphere 136 has a diameter larger than the downstream end opening of the cage 135, whereby the sphere 136 will not disengage from the cage 135 and will seal the casing to achieve pressureout when the casing is applied a pressure. Preferably, when the sphere 136 is at the upstream and downstream ends of the cage 135, the sphere 136 would not block the fluid passage 137 on the circumferential wall of the cage 135. In another embodiment, the opening area at the downstream end of the cage 135 is less than or equal to the total area of the fluid passage 137 on the circumferential wall of the cage 135.

Figure 18:
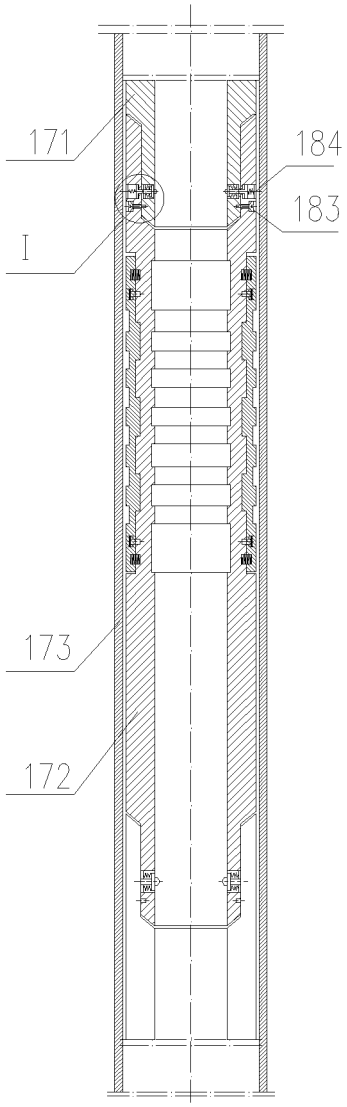
FIG. 18 is a schematic drawing showing an opening tool string of the sleeve fracturing assembly according to the second aspect of the present disclosure.

A sleeve fracturing device according to the second aspect of the present disclosure comprises a plurality of sleeve fracturing assemblies in accordance with the second aspect of the present disclosure. According to the second aspect of the present disclosure, each composite sleeve can be positioned at a required place of a casing 173. After that, the opening tools 120 as shown in FIG. 13 are connected to form an opening tool string, which is then put down into the casing 173 as shown in FIG. 18. Subsequently, the driving tool 130 is put down to engage with the corresponding opening tool 120 of the opening tool string, which promotes the opening tool 120 to disengage from the opening tool string. Afterwards, the disengaged opening tool 120 glides down the casing to couple with the inner tube of the corresponding composite sleeve, thereby opening the composite sleeve.

In the above embodiment, each opening tool in the opening tool string is configured that the second and third teeth-shaped members thereof are respectively different from the second and third teeth-shaped members of any other opening tool, so that each opening tool can only be engaged with a single inner tube, i.e., the inner tube of the composite sleeve in the sleeve assembly associated with said opening tool, each opening tool can only be engaged with a single driving tool, i.e., the driving tool in the sleeve assembly associated with said opening tool, and that each composite sleeve can only be engaged with a single second closing tool, i.e., the second closing tool in the sleeve assembly associated with said composite sleeve.

Before the opening tool is put down, the second teeth-shaped member of the opening tool projects out of the main body under the actuation of the spring and the limit screw of the first spring mechanism. As the opening tool is putting down, the second teeth-shaped member will not eject out due to the squeezing action from the inner tubes of other composite sleeves before being engaged with the first teeth-shaped member of the sleeve assembly associated with said second teeth-shaped member. The second teeth-shaped member of the opening tool will not eject out from the main body of the opening tool under the actuation of the spring to be engaged with the first teeth-shaped member of the sleeve assembly until said opening tool reaches the first teeth-shaped member of the fracturing assembly associated with said opening tool. It is easily understood that the engagement between the fourth teeth-shaped member of the driving tool and the third teeth-shaped member of the opening tool, that between the sixth teeth-shaped member of the second closing tool and the first teeth-shaped member of the composite sleeve or between the sixth teeth-shaped member of the second closing tool and the third teeth-shaped member of the opening tool can be similarly achieved, whereby the operation similar to "opening different locks with different keys" can be achieved.

Figure 16:
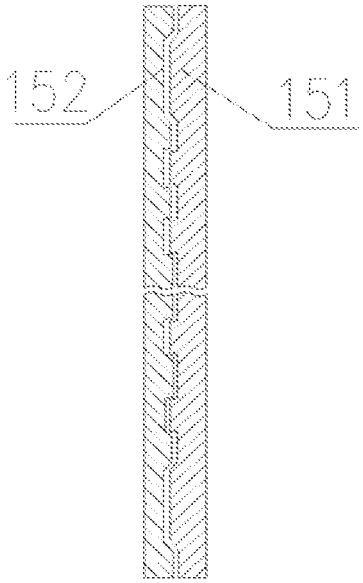
FIG. 16 is a schematic drawing of a guiding structure of a teeth-shaped member according to the second aspect of the present disclosure.
Figure 17A:
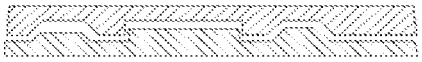
FIGS. 17*a* to 17*c* are schematic drawings showing the principle unique engagement between and among the teeth-shaped members according to the second aspect of the present disclosure.
Figure 17B:
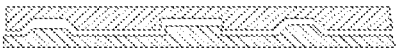
Figure 17C:
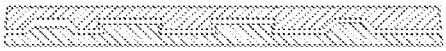

FIGS. 17*a* to 17*c* schematically illustrate how each teeth-shaped member is engaged with a unique corresponding teeth-shaped member. Each teeth-shaped member engages with the unique corresponding teeth-shaped member via unique contour parameters thereof, which, for example, can be one or more selected from the group consisting of tooth profile as shown in FIG. 17*a*, teeth space as shown in FIG. 17*b* and tooth number as shown in FIG. 17*c*. Preferably, a guiding structure 151 on each teeth-shaped member can also be configured as only capable of engaging with one single corresponding structure 152, whereby each teeth-shaped member achieves engagement with one single corresponding teeth-shaped member, as schematically indicated in FIG. 16. It is easily understood, the contour parameters of the teeth-shaped member can be used in combination with the guiding structure. Preferably, a side surface and bottom surface of at least one tooth and/or tooth space of the teeth-shaped member form an angle of 90 degrees or less than 90 degrees, i.e., form a rectangular tooth or hook tooth, so that the teeth-shaped members can be stably engaged without being separated from each other under excessive forces.

According to the second aspect of the present disclosure, the contour parameters and/or guiding structure of one teeth-shaped member should be configured as enabling the teeth-shaped member to identify the single corresponding teeth-shaped member associated with said teeth-shaped member. When the contour parameters and/or guiding structure of one teeth-shaped member completely match with those of another teeth-shaped member, either of the teeth-shaped members will engage with and enter into the other teeth-shaped member under an elastic force, so that the two teeth-shaped members are coupled with each other to open or close the composite sleeve, whereby the composite sleeve can be opened or closed at any fixed position.

Preferably, except the second and third teeth-shaped members, the sizes of other components of each opening tool are completely the same as those of the corresponding components of any other opening tools, so that the size of an upstream end of each opening tool precisely matches with the size of a downstream end of an upstream opening tool. As shown in FIG. 18, a downstream end portion of an upstream opening tool 171 can just be inserted into an upstream end portion of a downstream opening tool 172, and a coupling mechanism is disposed at an insertion and engagement portion of the opening tools 171 and 172. With this arrangement, a plurality of opening tools can be connected to form an opening tool string.

Figure 19:
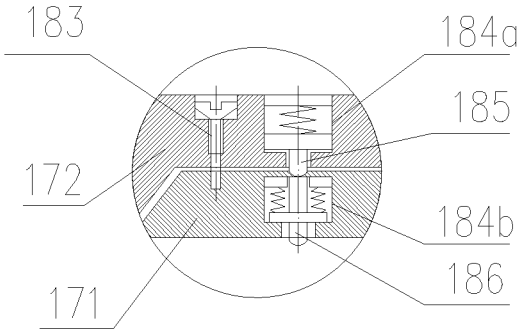
FIG. 19 is an enlarged drawing of Area I in FIG. 18.

FIG. 19 shows an enlarged view of the coupling mechanism, which comprises a shear pin 183 and a setback pin 184. In a state when a plurality of opening tools are connected to form an opening tool string, one portion of the shear pin 183 is arranged inside the downstream opening tool 172, and another portion thereof is arranged inside the upstream opening tool 171 associated with the downstream opening tool 172, so that the two opening tools are connected to each other and bear a shear load.

As shown in FIG. 19, the setback pin 184 comprises a first and second known sub-setback pins 184*a* and 184*b*. In the connection state as shown, the first sun-setback pin 184*a* is disposed in the downstream opening tool 172 while the second sub-setback pin 184*b* is disposed in the upstream opening tool 171. Under the actuation of the spring, a pin shaft 186 of the second sub-setback pin 184*b* extends out of a surface of the upstream opening tool 171, while a pin shaft 185 of the first sub-setback pin 184*a* extends out of a fitting surface of the downstream opening tool 172 and abuts against the pin shaft 186 of the second sub-setback pin 184*b*. Therefore, the setback pin 184 also bears part of the shear load.

Figure 20:
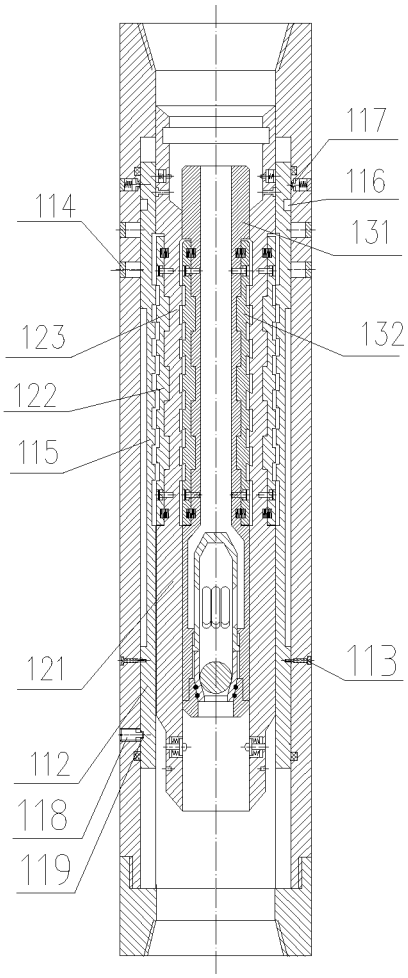
FIG. 20 is a schematic drawing of the positional relationship of the composite sleeve, the opening tool and the driving tool according to the second aspect of the present disclosure.

After the driving tool 130 and the downstream opening tool 172 are coupled with each other, an upstream portion of the driving tool 130 would press a tail end of the pin shaft 186 of the second sub-setback pin 184*b* of the setback pin 184, and thus force the pin shaft 185 of the first sub-setback pin 184*a* back into the downstream opening tool 172. In this way, only the shear pin 183 would bear the shear load. When the pressure within the casing 173 exceeds the shear strength of the shear pin 183, the shear pin 183 is sheared, so that the downstream opening tool 172 disengages from the opening tool string, as shown in FIG. 20. Subsequently, the process of opening or closing the composite sleeve as described above can be performed, which will not be repeatedly described here.

In the following a fracturing process with the sleeve fracturing device according to the second aspect of the present disclosure will be descried with reference to FIGS. 12*a* to 20. First, a pressure gradient opening mechanism (not shown) is mounted at the lowest end of a casing 173 or tubing string before successively mounting the composite sleeves in each fracturing assembly. In one embodiment, the pressure gradient opening mechanism can adopt a pressure gradient sleeve or a sandblasting hole that is well known in the prior art. After that the opening tools of the sleeve assemblies according to the second aspect of the present disclosure are connected to form an opening tool string, which is then put down into the sleeve until the uppermost opening tool reaches a predetermined position. Subsequently, pressure is applied in the wellbore to open the pressure gradient opening mechanism at the lowest end, so as to establish a communication passage between the casing 173 or tubing string with stratum. Finally, the driving tools are put down in sequence to open the composite sleeves step by step from bottom to top for carrying out staged fracturing.

After the staged fracturing is completed, each combination of opening tool and driving tool or each driving tool alone are fished out in a sequence from top to bottom of the wellbore with the fishing tool (not shown), so that the oil or gas passage in the sleeve or tubing string is restored. When a specific fracturing passage needs to be closed, the second closing tool associated with the sleeve associated with said fracturing passage is put down and the sleeve is closed according to the process described in the second aspect of the present disclosure about the second closing tool, whereby the specific fracturing passage is closed.

The fracturing devices according to the first or second aspect of the present disclosure are not limited to the fracturing operations in horizontal oil wells, but can also be applied in the field of stratum fracturing where a sleeve needs to be opened or closed at fixed positions similarly.

Although the present disclosure has been discussed with reference to preferable embodiments, it extends beyond the specifically disclosed embodiments to other alternative embodiments and/or use of the disclosure and obvious modifications and equivalents thereof. The scope of the present disclosure herein disclosed should not be limited by the particular disclosed embodiments as described above, but encompasses any and all technical solutions following within the scope of the following claims.

The invention claimed is:

1. A sleeve fracturing assembly comprising:

a composite sleeve having a fixed outer tube and an inner tube connected to an inner wall of the outer tube via a shear pin, wherein the outer tube is provided with a sandblasting hole and an inner wall of the inner tube is provided with a first teeth-shaped member; and an opening tool having a main body and a second teeth-shaped member connected to the main body, wherein the opening tool is configured to be inserted into the inner tube to seal a wellbore, and the second teeth-shaped member is configured to be engaged with the first teeth-shaped member, wherein in an initial state of the sleeve fracturing assembly, the sandblasting hole is blocked by the inner tube;

as the opening tool is put down, the inner tube engages with the opening tool via the first and second teeth-shaped members; and when the pressure inside a casing reaches a predetermined value, the shear pin is sheared and the opening tool drives the inner tube to move downward to expose the sandblasting hole, so that a fracturing passage is established, wherein the second teeth-shaped member of the opening tool is provided on the outer wall of the main body with a third spring mechanism disposed between the main body and the second teeth-shaped member, wherein the second teeth-shaped member is configured to move radially outward under the actuation of the third spring mechanism so as to engage with the first teeth-shaped member, and wherein each of the first and second teeth-shaped members has a plurality of protrusions.

2. The assembly according to claim 1, wherein the second teeth-shaped member of the opening tool is provided above the main body via an elastic member, one end of the elastic member connected to the main body having a smaller diameter than the other end of the elastic member connected to the second teeth-shaped member.

3. The assembly according to claim 1, wherein the fitting surfaces of the outer tube and the inner tube of the composite sleeve are provided with corresponding positioning mechanisms that are configured to be engaged with one another, so as to ensure that the inner tube engages with the outer tube so that the sandblasting hole is blocked and hence the fracturing passage is closed.

4. A sleeve fracturing assembly comprising:

a composite sleeve having a fixed outer tube and an inner tube connected to an inner wall of the outer tube via a shear pin, wherein the outer tube is provided with a sandblasting hole and an inner wall of the inner tube is provided with a first teeth-shaped member; and an opening tool having a main body and a second teeth-shaped member connected to the main body, wherein the opening tool is configured to be inserted into the inner tube to seal a wellbore, and the second teeth-shaped member is configured to be engaged with the first teeth-shaped member, wherein in an initial state of the sleeve fracturing assembly, the sandblasting hole is blocked by the inner tube;

as the opening tool is put down, the inner tube engages with the opening tool via the first and second teeth-shaped members; and when the pressure inside a casing reaches a predetermined value, the shear pin is sheared and the opening tool drives the inner tube to move downward to expose the sandblasting hole, so that a fracturing passage is established, wherein the main body is a hollow tubular body with the second teeth-shaped member arranged on an outer wall thereof, and comprises a third teeth-shaped member arranged on an inner wall thereof, and a first spring mechanism arranged between the main body and the second teeth-shaped member, wherein the second teeth-shaped member is capable of moving outward under the actuation of the first spring mechanism so as to be coupled with the first teeth-shaped member; and said assembly further comprises a driving tool with a central body, a fourth teeth-shaped member arranged on an outer wall of the central body, and a second spring mechanism disposed between the central body and the fourth teeth-shaped member, wherein the driving tool is configured to be inserted into the opening tool so as to seal the wellbore, and the fourth teeth-shaped member is configured to move outward under the actuation of the second spring mechanism so as to be coupled with the third teeth-shaped member, wherein when the opening tool and the driving tool are successively put down, the inner tube engages with the opening tool via the first and second teeth-shaped members, and the opening tool engages with the driving tool via the third and fourth teeth-shaped members; and when the pressure in the casing reaches a predetermined value, the shear pin is sheared and the driving tool together with the opening tool drives the inner tube to move downward to expose the sandblasting hole, so as to establish the fracturing passage, wherein each of the first, second, third and fourth teeth-shaped members has a plurality of protrusions.

5. The assembly according to claim 4, wherein a second closing tool comprising a central pull rod and a sixth teeth-shaped member connected to the central pull rod is further provided for closing the composite sleeve, wherein the second closing tool is configured to be inserted into the inner tube or the tabular body of the opening tool, so that the sixth teeth-shaped member is configured to be engaged with the first teeth-shaped member of the inner tube or the third teeth-shaped member of the opening tool, whereby the inner tube is configured to be moved upward via lifting the second closing tool, thus re-blocking the sandblasting hole so as to close the fracturing passage, wherein each of the fifth and sixth teeth-shaped members has a plurality of protrusions.

6. The assembly according to claim 5, wherein the sixth teeth-shaped member of the second closing tool is provided on an outer wall of the respective central pull rod with a fourth spring mechanism disposed between the central pull rod of the first closing tool and the fifth teeth-shaped member and a fifth spring mechanism disposed between the central pull rod of the second closing tool and the sixth teeth-shaped member wherein the fifth or sixth teeth-shaped member is configured to move radially outward under the actuation of the respective spring mechanism so as to engage with a corresponding one of the teeth-shaped member.

7. The assembly according to claim 5 wherein the sixth teeth-shaped member of the second closing tool is a leaf spring member, a lower end of which is connected to the respective central pull rod and an upper end thereof is separated from the respective central pull rod.

8. The assembly according to claim 5, wherein a position-selecting groove and a position-selecting member are provided in respective fitting surfaces of the inner tube and the outer tube of the composite sleeve, and are disposed at different relative positions when the sleeve fracturing assembly is in an open state and when the fracturing passage is closed.

9. The assembly according to claim 5, wherein each of the teeth-shaped members is provided with an inclined guiding structure at an upper end and a lower end thereof for guiding engagement or disengagement of a corresponding one of the teeth-shaped members.

10. The assembly according to claim 5, wherein each of the spring mechanisms comprises an elastic member that is configured to exert a radially outward force, and a limit stop for limiting the distance of a corresponding one of the teeth-shaped members that is configured to move radially outward.

11. A sleeve fracturing device, comprising a plurality of the sleeve fracturing assemblies according to claim 5, wherein the second and third teeth-shaped members of each opening tool are respectively configured as different from the second and third teeth-shaped members of any other opening tool, so that each opening tool is configured to only engage with the inner tube in the fracturing assembly associated with said opening tool; and the sixth teeth-shaped member of each second closing tool is configured as different from the sixth teeth-shaped member of any other second closing tools, so that each second closing tool is configured to only engage with the first teeth-shaped member in the inner tube or the third teeth-shaped member in the opening tool of the fracturing assembly associated with said second closing tool.

12. The device according to claim 11, wherein each teeth-shaped member is configured to engage with a unique corresponding teeth-shaped member via unique contour parameters thereof and/or the guiding structure arranged thereon.

13. The device according to claim 12, wherein the contour parameters are one or more selected from a group consisting of tooth number, tooth profile and teeth space.

14. The device according to claim 11, wherein all the composite sleeves have the same inner diameter.

15. A method of using the sleeve fracturing device according to claim 11, comprising:

Step I: providing a pressure gradient opening mechanism at a lowest end of a casing or tubing string, and then mounting the sleeve fracturing device above the pressure gradient opening mechanism;

Step II: applying pressure in the casino or tubing string to open the pressure gradient opening mechanism at the lowest end and establish a communication passage between the casing or tubing string with a stratum; and Step III: putting down the driving tools of each in sequence to open the composite sleeves from bottom to top for carrying out staged fracturing.

16. The method according to claim 15, wherein Step IV is further provided: recovering each opening tool and each driving tool using a fishing structure on each opening tool or merely recovering each driving tool using the fishing structure on each driving tool.

17. The method according to claim 16, wherein when a specific fracturing passage needs to be closed, the second closing tool of a corresponding composite sleeve associated with said fracturing passage is put down so as to close the fracturing passage.

18. The assembly according to claim 4, wherein the main body of the driving tool comprises a through hollow structure with different sizes of cross sections, wherein a lower portion of the through hollow structure with a larger cross section is arranged with a pressureout mechanism, which cannot enter into the upper portion of the through hollow structure with a smaller cross section.

19. The assembly according to claim 18, wherein the pressureout mechanism comprises a cage and a sphere arranged inside the cage, wherein the cage comprises an open lower end, a closed upper end with a fishing handle at an outer side thereof, and a fluid passage on a circumferential wall of the cage, the sphere merely being capable of moving inside the cage without blocking the fluid passage on the circumferential wall of the cage when being disposed at the upper or lower end thereof.

20. The assembly according to claim 19, wherein the fluid passage on the circumferential wall of the cage has a total area not less than the opening area at the lower end of the cage.

* * * * *